US011229293B2

(12) United States Patent
Budiman

(10) Patent No.: US 11,229,293 B2
(45) Date of Patent: Jan. 25, 2022

(54) ADJUSTABLE TOOL-FREE ERGONOMIC HEADREST FOR A DESK CHAIR

(71) Applicant: Ali Budiman, Elmhurst, NY (US)

(72) Inventor: Ali Budiman, Elmhurst, NY (US)

( * ) Notice: Subject to any disclaimer, the term of this patent is extended or adjusted under 35 U.S.C. 154(b) by 0 days.

(21) Appl. No.: 16/841,878

(22) Filed: Apr. 7, 2020

(65) Prior Publication Data

US 2021/0007491 A1 Jan. 14, 2021

Related U.S. Application Data

(60) Provisional application No. 62/871,314, filed on Jul. 8, 2019.

(51) Int. Cl.
*A47C 1/10* (2006.01)
*A47C 7/38* (2006.01)

(52) U.S. Cl.
CPC ..... *A47C 7/38* (2013.01); *A47C 7/383* (2013.01)

(58) Field of Classification Search
CPC ..... B60N 2/844; B60N 2/859; B60N 2/847; B60N 2/856; B60N 2/809; B60N 2/838; B60N 2/853; B60N 2/841; A47C 7/38; A47C 7/383
USPC ..... 297/408
See application file for complete search history.

(56) References Cited

U.S. PATENT DOCUMENTS 5,058,790 A 10/1991 LaVelle
5,346,283 A * 9/1994 Steininger ..... A47C 1/036 297/284.1
6,755,472 B2 * 6/2004 Stenzel ..... A47C 7/38 297/408
7,494,188 B1 * 2/2009 Lin ..... A47C 7/383 297/397
7,690,729 B2 * 4/2010 Liao ..... A47C 7/38 297/408
7,832,803 B2 11/2010 Cassaday
7,914,079 B2 * 3/2011 Link ..... A47C 7/38 297/408
8,662,591 B2 * 3/2014 Lin ..... A47C 7/38 297/397
9,521,908 B1 * 12/2016 Beck ..... A47C 7/38
10,681,986 B1 * 6/2020 Sanders ..... A45D 44/10
(Continued)

FOREIGN PATENT DOCUMENTS

DE 102004019079 A1 5/2005
DE 202006009832 U1 10/2007
(Continued)

*Primary Examiner* — Shin H Kim
(74) *Attorney, Agent, or Firm* — Hanrahan Law Firm, P.A.; Benjamin M. Hanrahan

(57) ABSTRACT

A removable and adjustable headrest capable of being manually installed without the assistance of a tool and which is adjustable about at least one axis is presented herein. The headrest includes a headrest frame, an adjustable clamping mechanism, an adjustable neck mechanism, a rocking arm assembly connected between the headrest frame and the adjustable neck mechanism, and at least one activation lever. The activation lever being connected to the headrest frame and being manually disposable between a normal position and an activated position. When the activation lever is held in the activated position, a gear assembly is disengaged, allowing the headrest to be manually tilted about an axis.

20 Claims, 18 Drawing Sheets

(56) References Cited

U.S. PATENT DOCUMENTS

| | | | | |
|---|---|---|---|---|
| 2007/0085401 | A1* | 4/2007 | Hunziker | A61G 5/12 297/410 |
| 2010/0201176 | A1* | 8/2010 | da Silva Netto | A47C 7/38 297/408 |
| 2012/0104807 | A1 | 5/2012 | Lauchle et al. | |
| 2016/0150885 | A1* | 6/2016 | Peterson | A47C 1/023 297/408 |
| 2017/0224117 | A1* | 8/2017 | DuFresne | A61G 5/121 |
| 2020/0179154 | A1* | 6/2020 | Stafford | A47C 16/00 |
| 2021/0007490 | A1* | 1/2021 | Budiman | A47C 7/38 |
| 2021/0007491 | A1* | 1/2021 | Budiman | A47C 7/38 |

FOREIGN PATENT DOCUMENTS

| | | | |
|---|---|---|---|
| DE | 202012011033 | U1 | 2/2013 |
| TW | M325045 | U | 1/2008 |
| WO | 2011005231 | A1 | 1/2011 |

* cited by examiner

ADJUSTABLE TOOL-FREE ERGONOMIC HEADREST FOR A DESK CHAIR

CLAIM OF PRIORITY/CROSS-REFERENCE TO RELATED APPLICATION

The present application is based on and a claim of priority is made under 35 U.S.C. § 119(e) to provisional patent application Ser. No. 62/871,314, filed on Jul. 8, 2019, the contents of which are incorporated herein in their entirety by reference.

FIELD OF THE INVENTION

The present invention is generally directed to a headrest for a chair, and more specifically to an adjustable and articulable headrest with an ergonomic design and which is configured to provide tool-free attachment to an existing chair.

BACKGROUND OF THE INVENTION

A number of office or desk chairs, including, but in no way limited to the AERON® chair offered by Herman Miller, Inc., often do not include integrated headrests. Although the chair, itself, may be functional and comfortable to the user, the absence of a headrest can often be a source of discomfort or inconvenience for the user. This, of course, may cause some users to purchase a different, perhaps inferior chair, that may include an integrated headrest.

Therefore, it would be beneficial to have a headrest assembly that can be selectively attached to a chair. It would also be advantageous if the removable headrest assembly is adjustable or otherwise movable in order to accommodate users of different heights or different users that may prefer the headrest to be positioned in different orientations. Accordingly, the proposed headrest may be adjustable about at least one axis, and in some cases, at least two horizontal axes, as well as a vertical axis in order to provide a plurality of different operative orientations to meet the preferences and desires of a wide range of users.

It would also be advantageous if the user were able to adjust the headrest about the various axes, including the horizontal axes and vertical axis while seated in the chair. In other words, it is not desirable to require the user to either request the assistance of another user for adjustment of the headrest to have to stand up, adjust the headrest, then sit back down, only to realize that the headrest is still not in the preferred orientation or position.

As another advantage, the proposed headrest assembly may be attached to and removed from the chair, and adjusted among the various axes, without the assistance of any tools, such as a screw driver, Allen wrench, hex key, etc. In this manner, the proposed headrest assembly can be easily installed onto the chair, adjusted to the desired position, and removed from the chair all manually and without any tools or assistance from additional users.

SUMMARY OF THE INVENTION

Accordingly, the present invention is generally directed to a manually adjustable headrest assembly that is easy to install and to adjust without the use of any tools or assistance from other users or individuals. The headrest assembly of at least one embodiment of the present invention includes a headrest frame, an adjustable clamping mechanism for attachment to and removal from the chair, a height-adjustable neck mechanism, a rocking arm assembly connected between said headrest frame and said adjustable neck mechanism, and a least one activation lever connected to said headrest frame in an easily accessible location while the user is seated.

In particular, the activation lever(s) is/are manually disposable between a normal position and an activated position. As an example, the activated position of the activation lever of at least one embodiment may be defined as the lever being manually pressed inward toward the headrest frame. When the lever is activated, and held in the activated state or position, the headrest can be manually tilted or moved about one axis.

Some embodiments include a second activation lever, disposed coaxially from the first lever, and extending from an opposite side of the frame. When the second lever is activated, and held in the activated state or position (in a similar manner in which the first lever can be activated), the headrest can be manually tilted or moved about a second and different axis. The first and second axes about which the headrest can be tilted via manipulation of the first and second levers may, in some cases, be parallel to one another and substantially horizontally aligned.

Furthermore, first and second gear assemblies may be disposed within corresponding first and second housing elements which are connected to the first and second activation levers, respectively. For example, depressing the first activation lever will manipulate the first gear assembly, or otherwise disengage the first gear assembly in a manner such that the headrest can be appropriately tilted or moved about the first axis. Similarly, depressing the second activation lever will manipulate the second gear assembly, or otherwise disengage the second gear assembly in a manner such that the headrest can be appropriately tilted or moved about the second axis.

Other features of some embodiments of the present invention may include a height adjustable neck mechanism or assembly which can be manually adjusted by the user while seated, for example, by pulling a neck portion out of a corresponding base or housing. Doing so will cause the neck portion to successively be disposed into different predetermined height positions.

A clamping mechanism may also be provided which includes at least one movable arcuate hook portion and at least one fixed arcuate hook portion. A corresponding lever may be pivoted in order to move the movable arcuate hook portion and engage a portion of the desk chair or other furniture.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
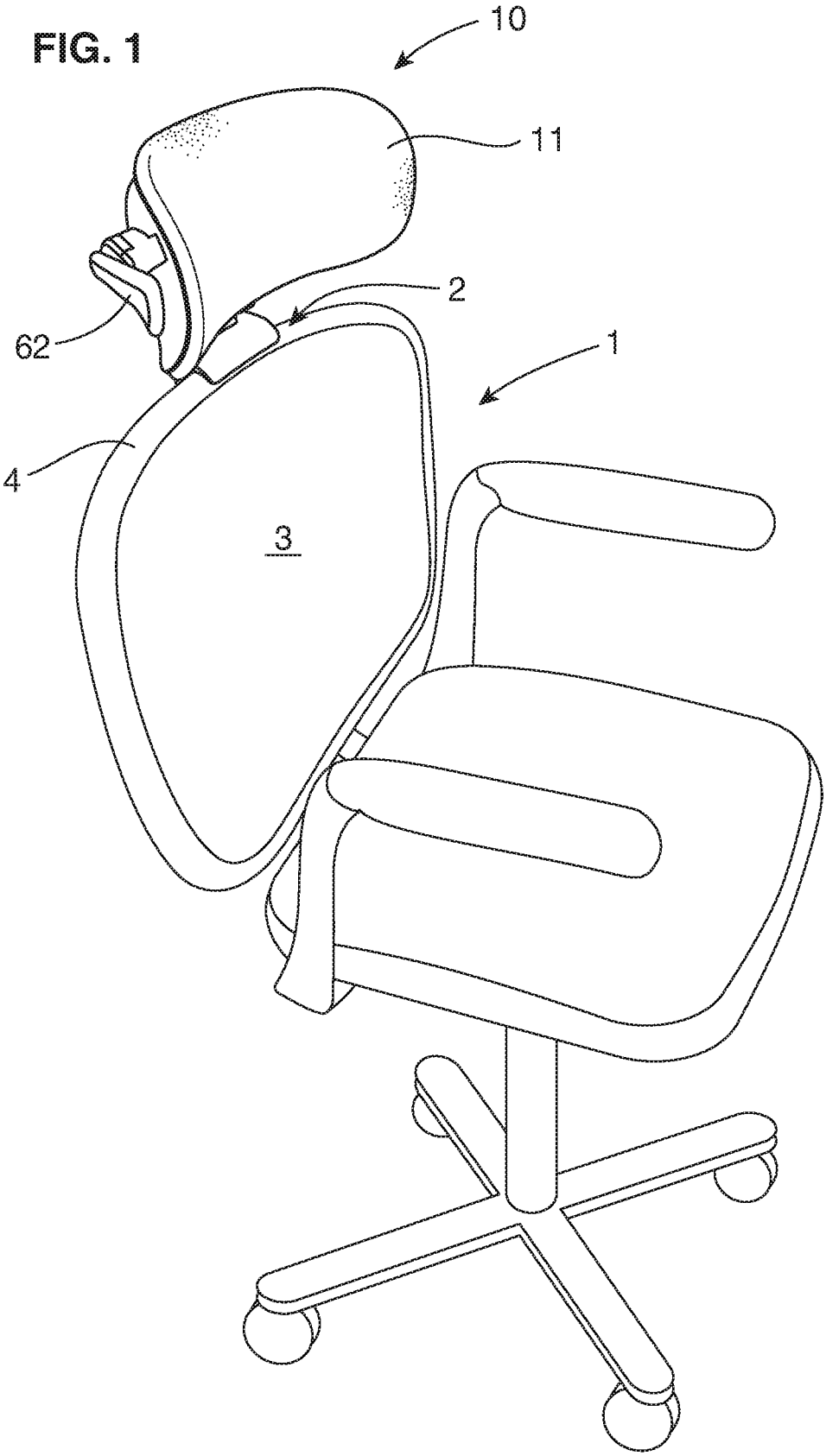
FIG. 1 is a front left perspective view of the headrest as disclosed in accordance with at least one embodiment of the present invention attached to the upper frame edge of an exemplary chair.

As shown in the accompanying drawings, and with particular reference to FIG. 1, for example, the present invention is directed to a headrest, generally shown as 10, which can be easily attached and removed from a chair without the use of any tools. More specifically, the headrest 10 of at least one embodiment of the present invention may be manually clamped or otherwise secured to an upper portion or upper edge 2 of an existing chair 1 without the need for additional tools, such as a screwdriver, Allen wrench, hex key, star hex key, etc. An additional benefit of certain embodiments of the present invention also allows a user to manually adjust the headrest 10 about at least one axis, and in some cases, at least two substantially horizontal axes, while seated in the chair 1, or otherwise, without having to stand up. For example, while seated, the user can easily reach with his or her hand(s) to manually manipulate one or more levers 60, 62 adapted to activate and/or deactivate one or more corresponding hinge mechanisms or gear assemblies.

As described herein, the lever(s) 60, 62 of at least one embodiment may extend from the side(s) of the headrest 10 and toward the front of the headrest 10 in a manner and position that is accessible by the user while the user is seated in the chair 1. This is advantageous because if the user were required to stand up in order to adjust the headrest 10 about the one or more axes, it may be difficult to adjust the headrest 10 into the desired orientation.

In addition, in at least one embodiment of the present invention, the headrest 10 may be used or otherwise removably attachable to desk chairs and/or office chairs, including the AERON® chair offered by Herman Miller, Inc. Of course, the headrest 10 of at least one embodiment of the present invention may be used with or otherwise removably attachable to other chairs and other furniture in addition to or instead of the AERON® chair.

For example, the chair 1 may include a back portion 3 with an outer edge 4. In many cases, the outer edge 4 may be rigid or substantially rigid and which surrounds a fabric or mesh back panel. In this manner, the outer edge 4 may provide structural support for the chair 1 and may define or include a lip to which the headrest 10 may be removably secured.

Figure 2A:
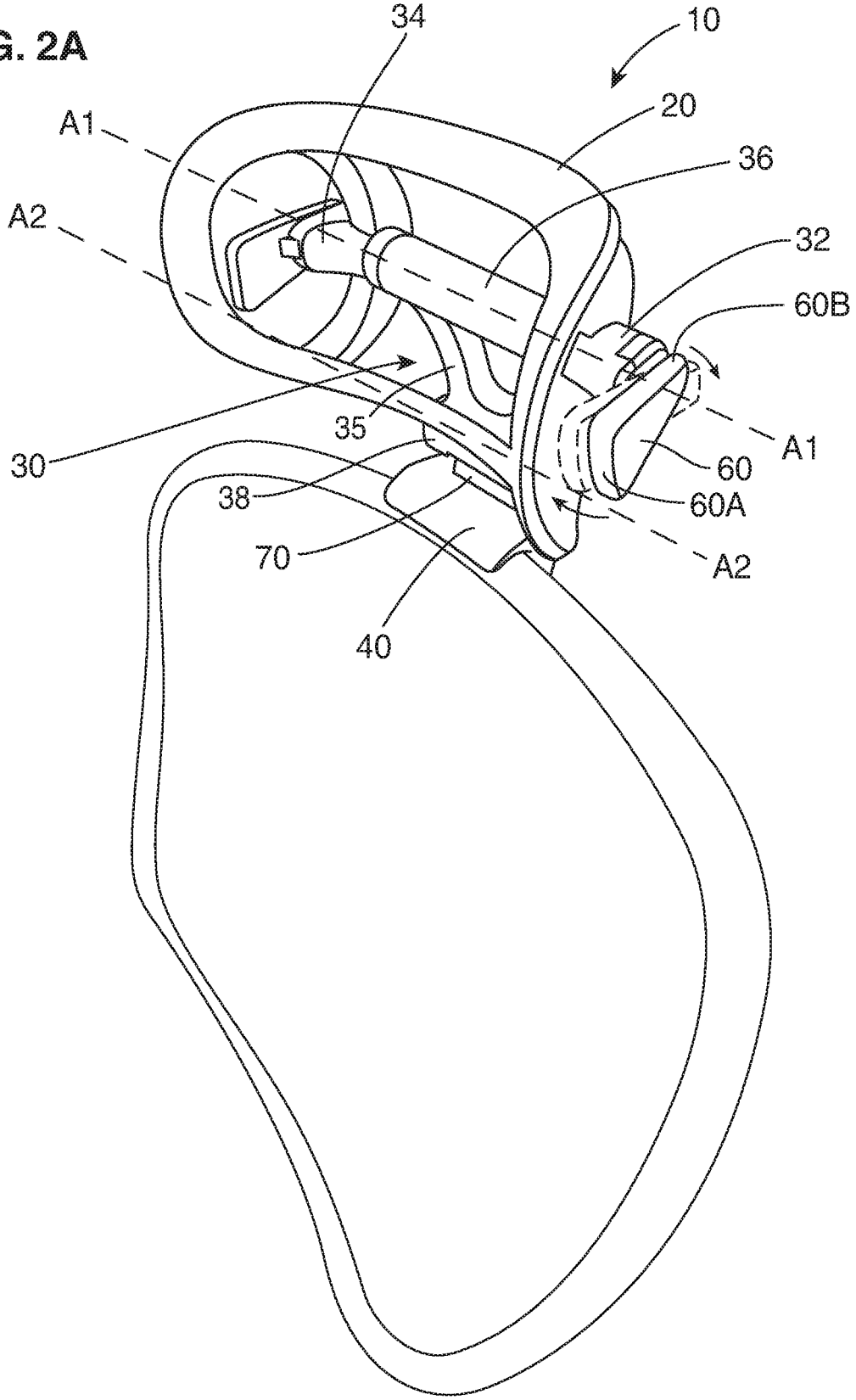
FIG. 2A is a front right perspective view of the headrest without a covering attached to the upper frame edge of an exemplary chair with the first lever shown in partial phantom lines indicating movement.

More in particular, and with reference for example to FIG. 2A, at least one embodiment of the headrest 10 of the present invention includes a frame 20 supported by a rocking arm assembly 30. The rocking arm assembly 30 may be connected to or at least partially supported by a neck mechanism 70 and a clamping or attachment mechanism 40. As will be described herein, the rocking arm assembly 30 of at least one embodiment includes at least one hinge mechanism to provide adjustment of the headrest 10. In a particular embodiment, the rocking arm assembly 30 includes two hinge mechanisms, such as upper and lower hinge mechanisms 50, 52, each activated or controlled via a different lever 60, 62. For instance, levers 60, 62 may be attached to or integrated with the frame 20 and rocking arm assembly 30, as described and illustrated herein.

Still referring to FIGS. 1 and 2A, in at least one exemplary embodiment, the headrest 10 and/or headrest frame 20 may be generally in the shape of a hyperbolic paraboloid, opening downward along an x-axis and upward along a y-axis to provide a shape that can comfortable receive the rear of the user's head. In certain cases, the frame 20 may comprise a continuous solid surface, or, as shown in FIG. 2A, for example, an outer frame 20 that tracks or defines the outer edge of the hyperbolic paraboloid with an open interior portion. As shown in FIG. 1, for example, the open interior portion of the frame 20 may be covered or at least partially covered, such as with fabric or mesh, which may match the material of the chair 1 for continuity and appeasing aesthetics. The cover 11 may be made from a polymer material that is durable and relatively lightweight.

Furthermore, in some cases, the interior portion of the frame 20 may contain foam or other material that may enhance the comfort of the user. In some embodiments, the shape of the headrest frame 20, and optional cover and/or filling, may be in a shape other than a hyperbolic paraboloid, such as, for example, a wedge, cylinder, or other shape that may be comfortable or appealing to the user.

Figure 2B:
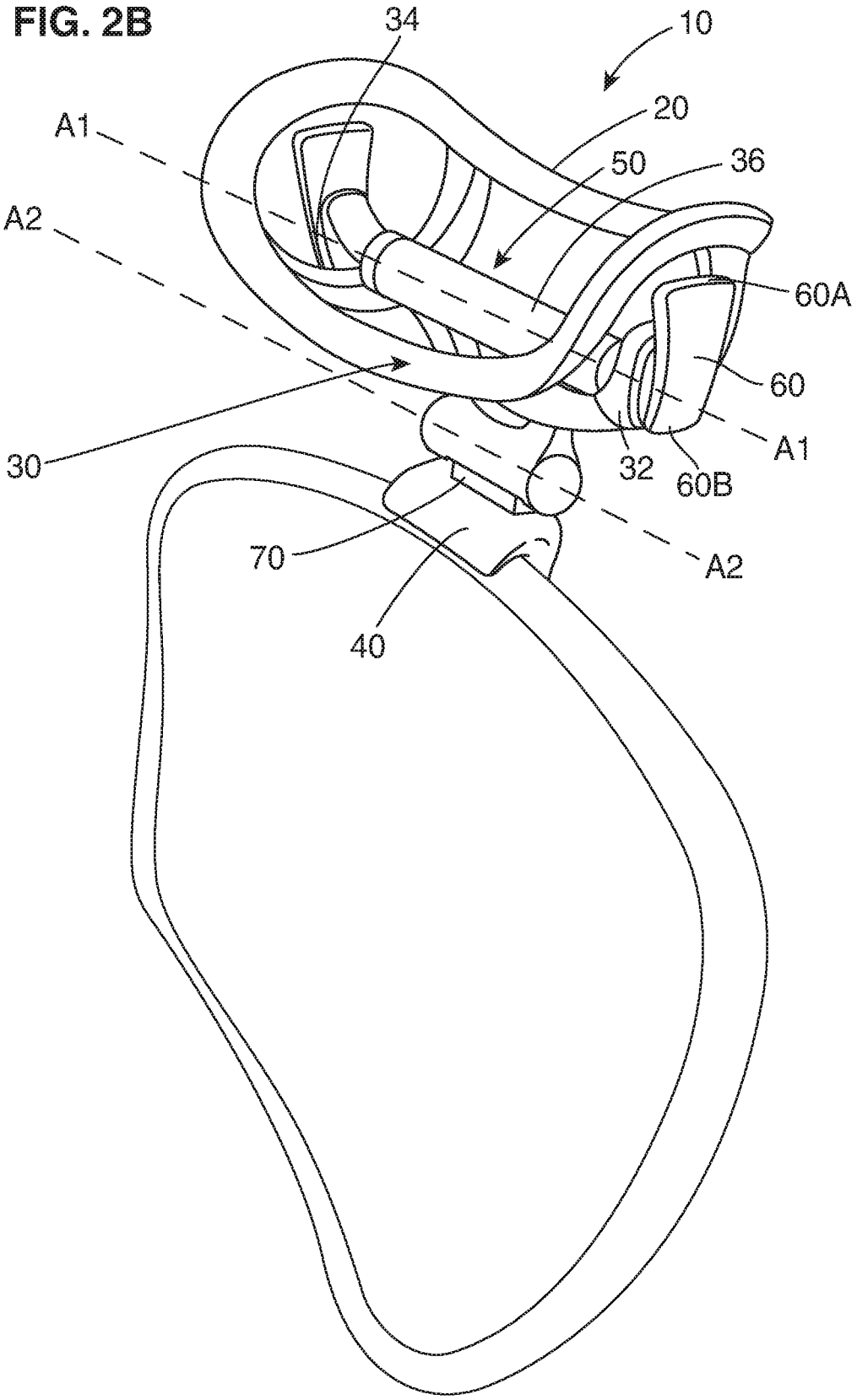
FIG. 2B is a front right perspective view of the headrest illustrated in FIG. 2A tilted about a first axis into a position different than that shown in FIG. 2A, as disclosed in accordance with at least one embodiment of the present invention.
Figure 2C:
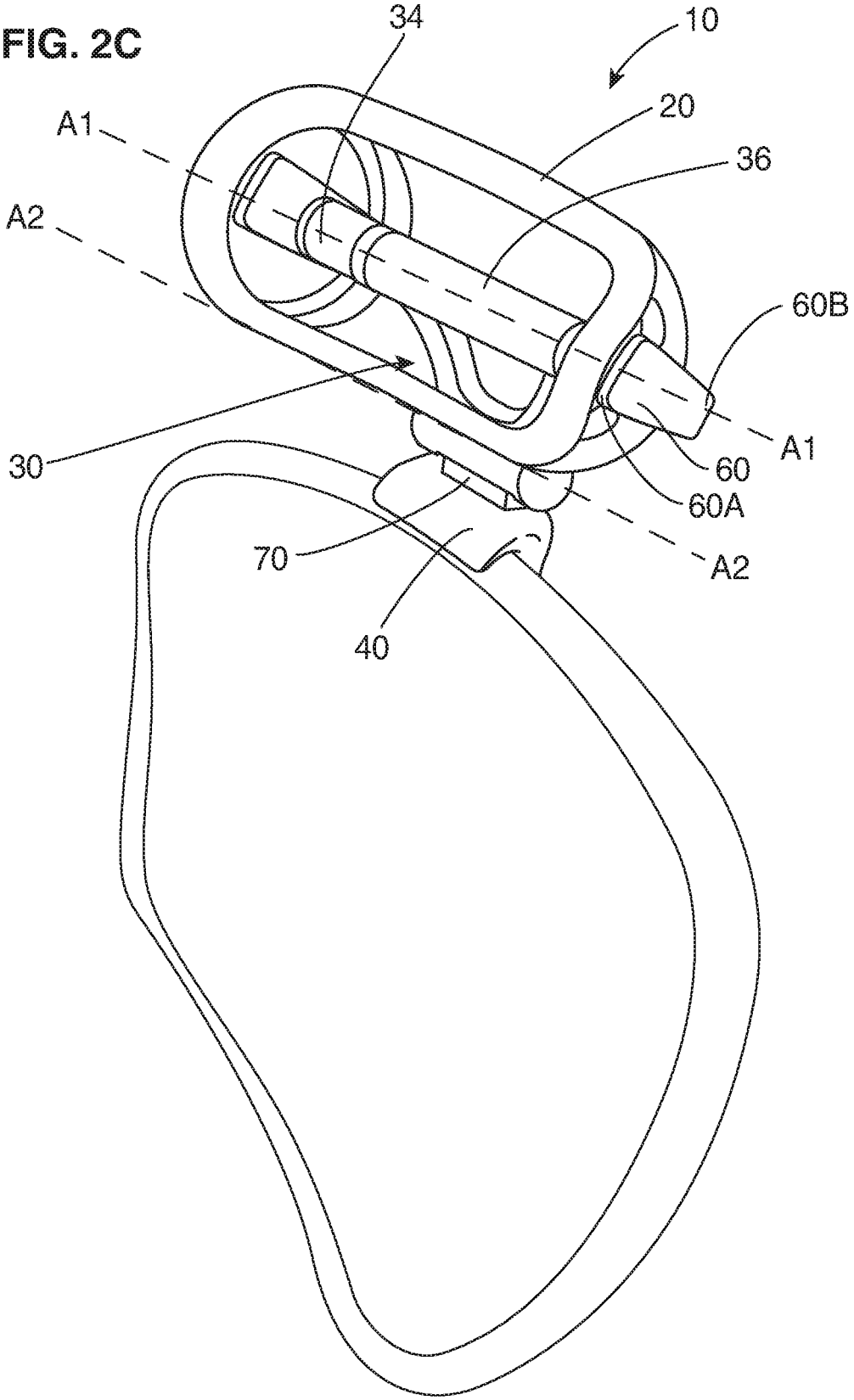
FIG. 2C is another front right perspective view of the headrest illustrated in FIG. 2A tilted about a first axis into a position different than that shown in FIG. 2A, as disclosed in accordance with at least one embodiment of the present invention.

Moreover, with reference to exemplary FIGS. 1 through 2C, the rocking arm assembly 30 of at least one embodiment provides a point of connection between frame 20 and neck mechanism 70. The neck mechanism 70 is connected to the clamp 40, which provides the attachment to the chair 1. More in particular, the rocking arm assembly 30 includes upper housing element 36 connected to first and second support arms 32, 34 to which the first and second levers 60, 62 are attached.

The rocking arm assembly 30 may further include a support 35 that is attached to or formed with the upper housing element 36, for example, at a top end, and a lower housing element 38 at a lower end. The support 35 may take any number of shapes, configurations or forms, including for example, a single, continuous solid element, multiple arms or supports, a single support with a space formed in the center, etc. In the exemplary embodiment illustrated in the Figures, the support 35 is formed with an open center area that improves the aesthetics of the headrest 10 and reduced the weight of the device, but still provides adequate support for the weight of the user.

The second or lower housing element 38 to which the support 35 is attached may provide a rotatable or pivotal connection to the neck mechanism 70.

In this manner, the upper and lower housing elements 36, 38 may be at least partially hollow in order to house or contain respective hinge mechanisms therein. The purpose of the cylindrical elements and hinges is to provide two-pint headrest rotation or movement about multiple axes, including a first or upper axis A1 and a second or lower axis A2.

Figure 4A:
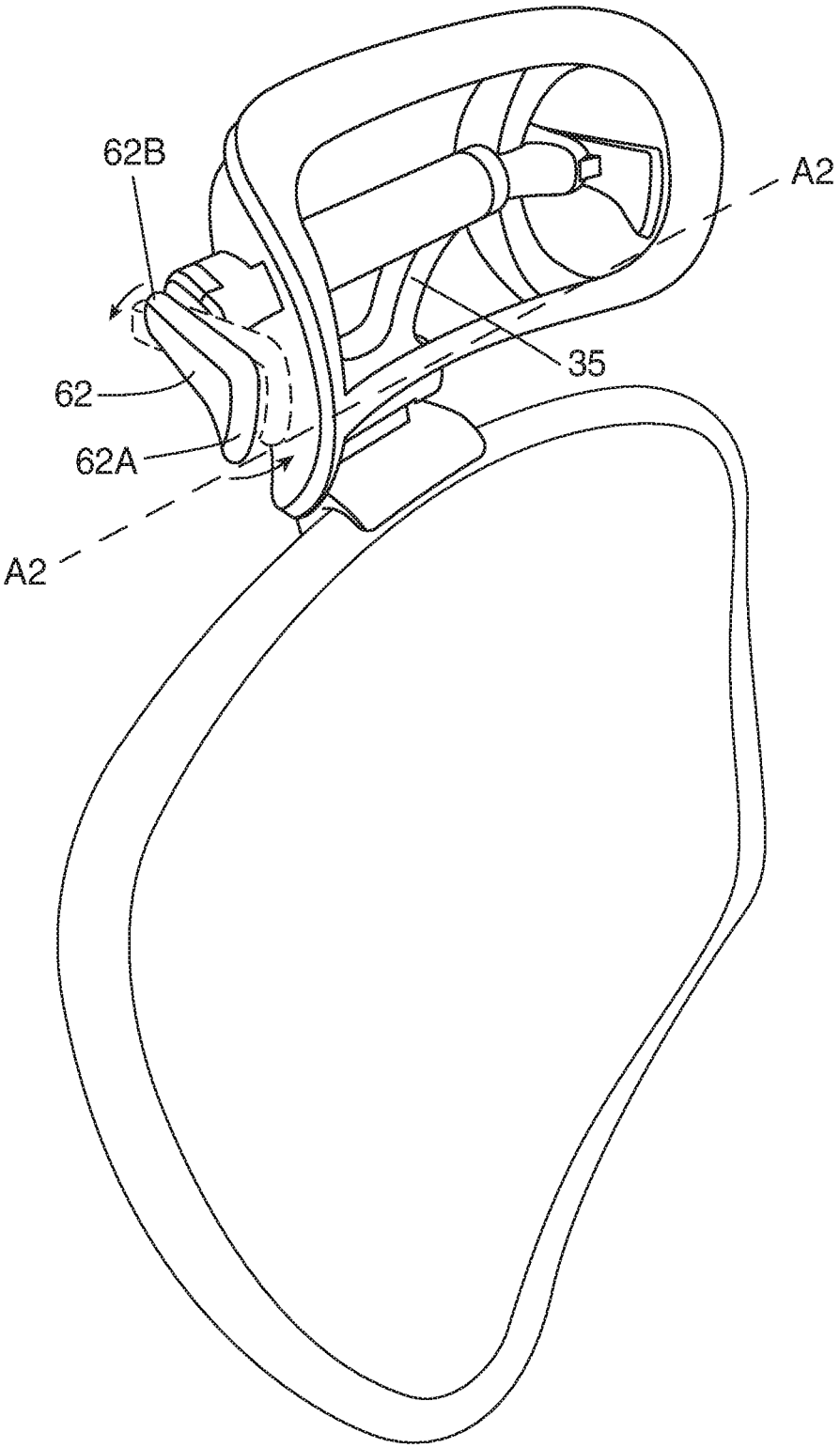
FIG. 4A is a front left perspective view of the headrest without a covering attached to the upper frame edge of an exemplary chair with the second lever shown in partial phantom lines indicating movement.
Figure 4B:
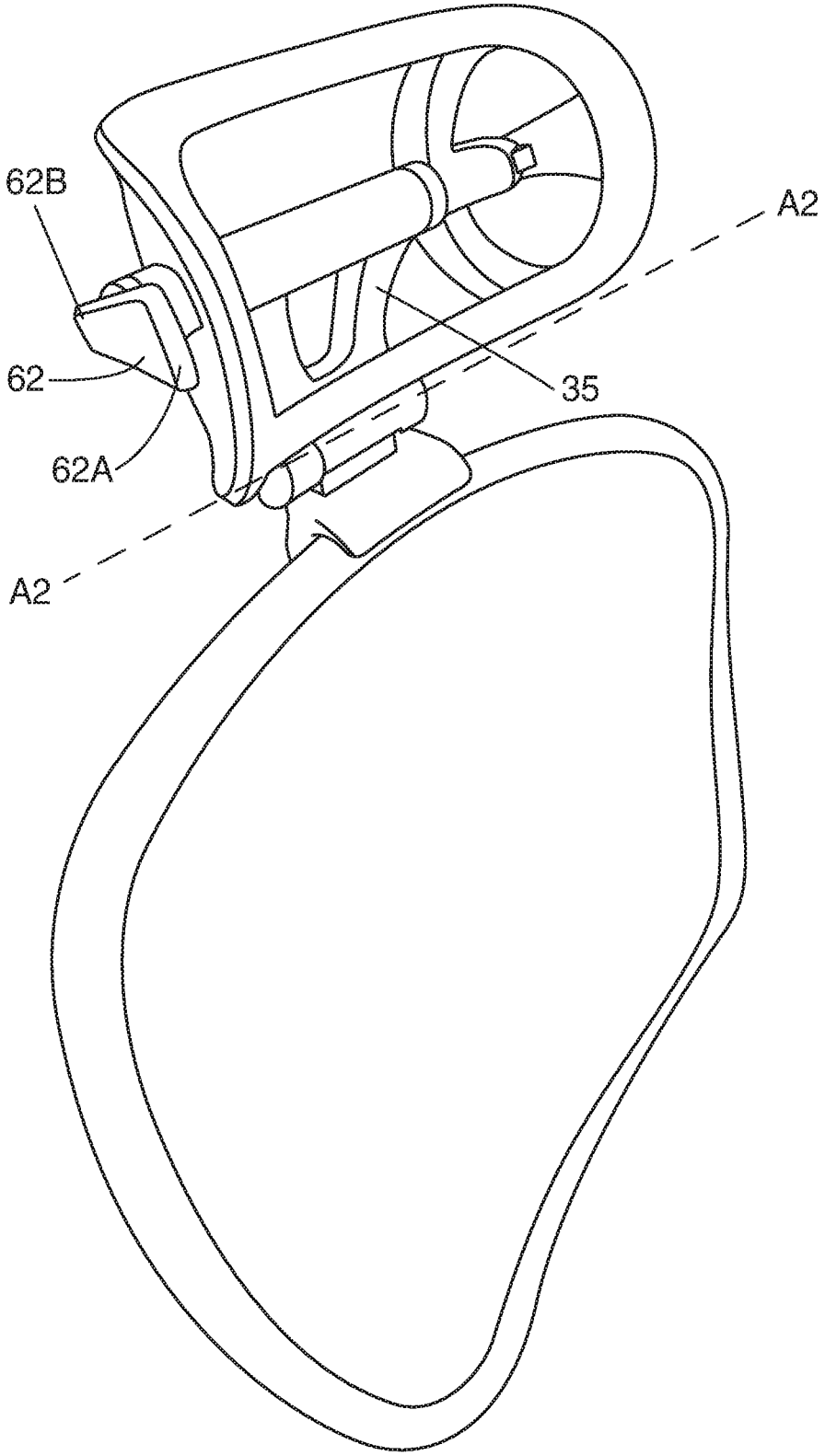
FIG. 4B is a front left perspective view of the headrest illustrated in FIG. 4A tilted about a second axis into a position different than that shown in FIG. 4A, as disclosed in accordance with at least one embodiment of the present invention.
Figure 4C:
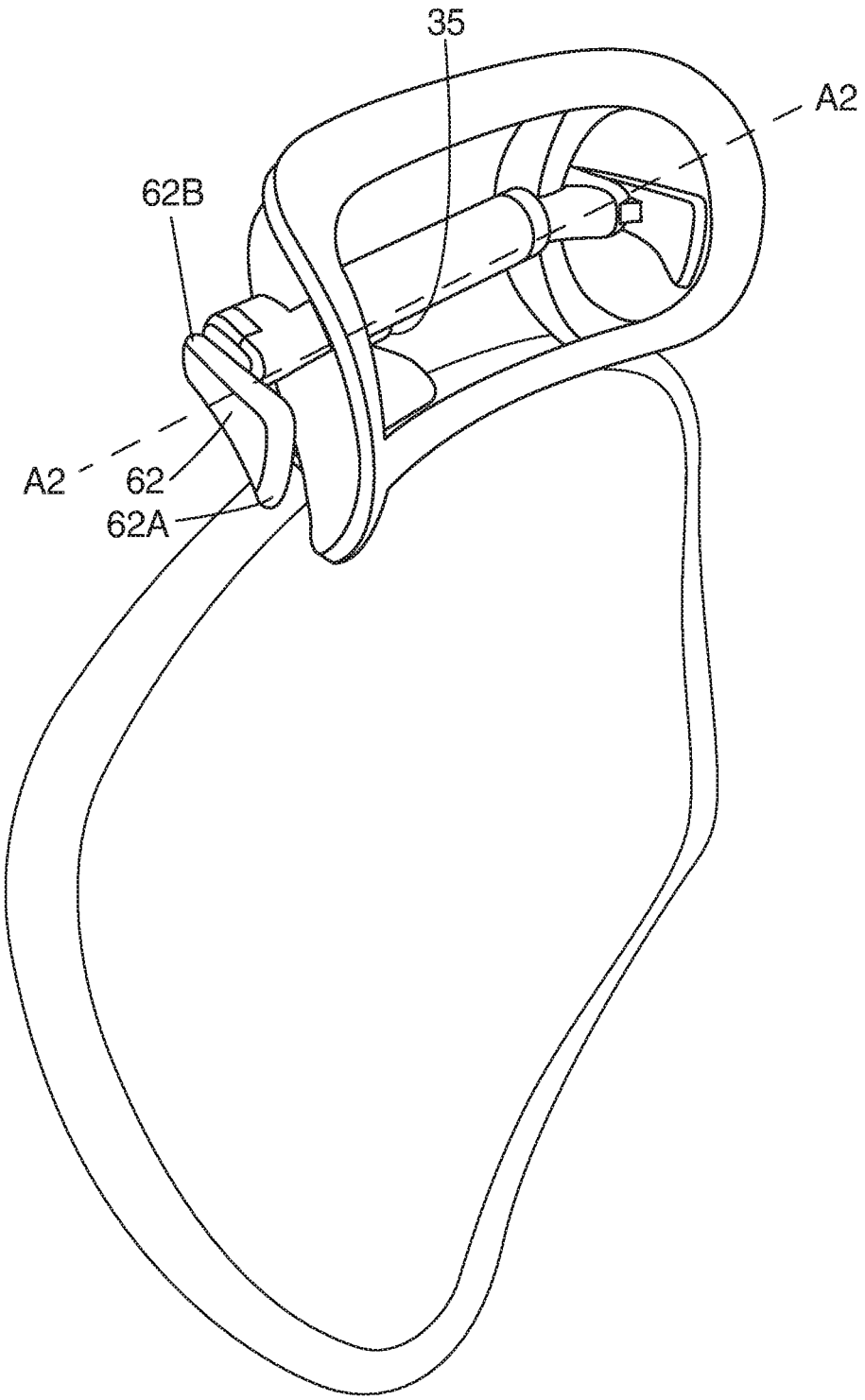
FIG. 4C is another front right perspective view of the headrest illustrated in FIG. 4A tilted about a second axis into a position different than that shown in FIG. 4A, as disclosed in accordance with at least one embodiment of the present invention.

For example, FIGS. 2A, 2B and 2C illustrate an exemplary headrest 10 being rotated or pivoted about first or upper axis A1, while FIGS. 4A, 4B and 4C illustrate the exemplary headrest 10 being rotated about a second or lower axis A2. In particular, a first lever 60 may be used or manually manipulated to control or allow rotation of the headrest 10 about axis A1, whereas a separate or second lever 62 may be used or manually manipulated to control or allow rotation of the headrest about axis A2. More specifically, lever 60 may be depressed to engage or disengage a gearing mechanism 100 housed within upper housing element 36 and lever 62 may be depressed to engage or disengage a gearing mechanism 200 housed within lower housing element 38.

For example, depressing first lever 60 causes the first gearing mechanism or assembly 100 to go into an unlocked condition (thereby allowing rotation of the headrest 10 about first or upper axis A1) while returning first lever 60 to its original or normal position (e.g., by releasing the lever 60) causes the first gearing mechanism 100 to automatically go into a locked condition (thereby preventing rotation of the headrest 10 about first or upper axis A1.) Similarly, depressing the second lever 62 will cause the second gearing mechanism 200 to go into an unlocked condition (thereby allowing rotation of the headrest 10 about second or lower axis A2), while releasing or returning the second lever 62 to its original or normal position causes the second gearing mechanism to automatically go into a locked condition (thereby preventing rotation of the headrest 10 about the second or lower axis A2.)

It will be appreciated by one of ordinary skill in the art that various methods and mechanisms can be employed for lever-based control of the rotation of the headrest 10. The drawings and description provided herein represent one such method. For example, FIGS. 3A through 3D represent one exemplary embodiment of the first gearing mechanism or assembly 100, whereas FIGS. 5 and 6A through 6D represent one exemplary embodiment of the second gearing mechanism 200.

Figure 3A:
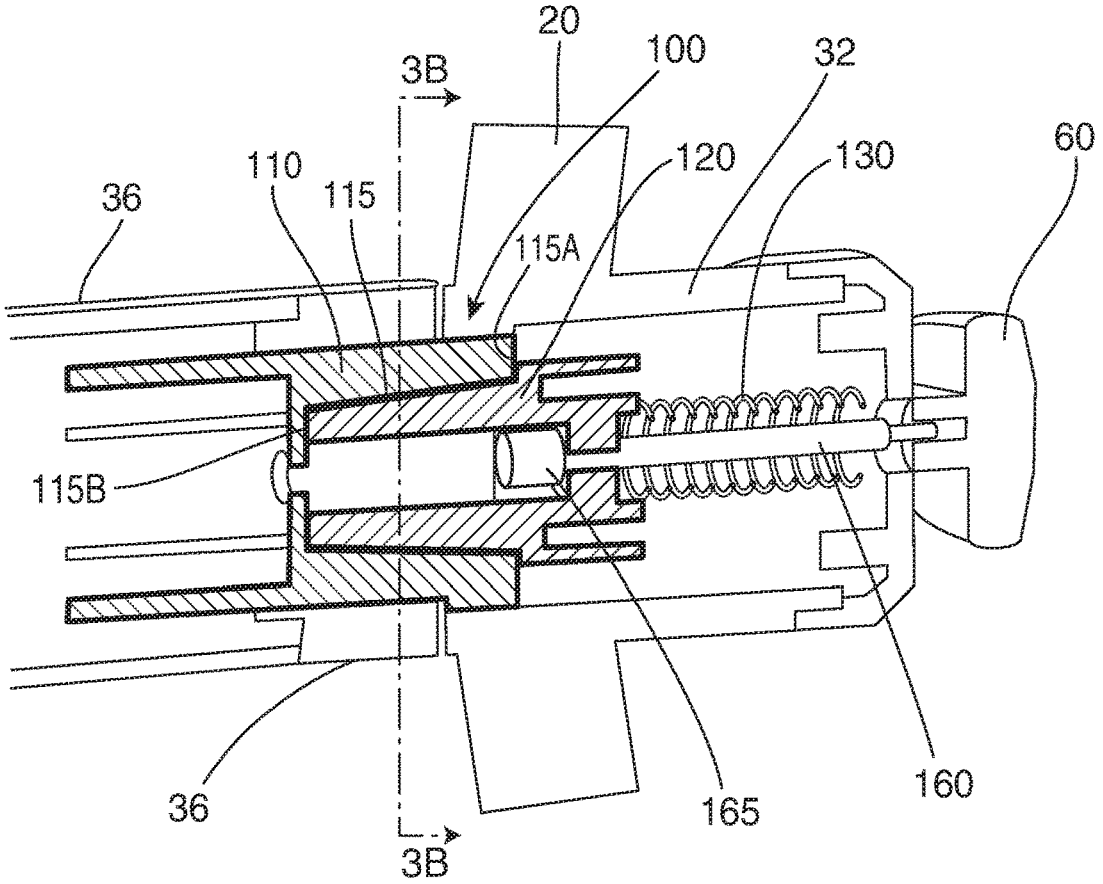
FIG. 3A is a cut-away view of the first lever and the first gear assembly disposed in a locked or engaged condition as disclosed in accordance with at least one embodiment of the present invention.

For example, with reference now to FIG. 3A, the first gearing mechanism 100 of at least one embodiment includes a fixed gear 110 and a movable gear 120. Fixed gear 110 is secured on the inside of the housing 36 and defines an interior or receiving area 115 within which movable gear 120 is disposed. A lever rod 160 is attached to lever 60 and extends into housing 36 and/or support arm 32. An attachment knob 165 attaches the rod 160 to the movable gear 120. For example, rod 160 may pass through a hole or bore on the end of movable gear 120 wherein knob or enlarged head 165 is secured to or integral with the rod 160 in a manner to secure the rod to movable gear 120.

In at least one embodiment, interior portion 115 of the fixed gear 110 may include a sloped or conical surface that tapers inward from an outer end 115A toward an inner end 115B. Movable gear 120 may include a corresponding sloped or tapered outer surface which mates with inner surface of the fixed gear 110.

Moreover, a spring or other biasing element 130 may be disposed a manner to normally bias the movable gear 120 into a locked engagement with the fixed gear 110, as represented in FIG. 3A. For example, biasing element 130 may normally press against the movable gear 120 on one end and against an interior housing surface or other surface at the other end to normally engage the movable gear 120 and the fixed gear 110 together.

Figure 3B:
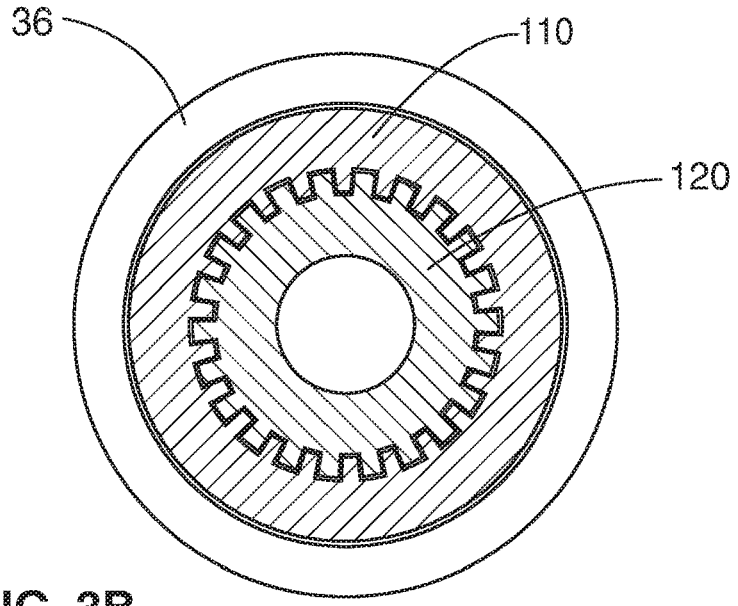
FIG. 3B is another cut-away view of a portion of the first gear assembly disposed in a locked or engaged condition as disclosed herein.

FIG. 3B represents a partial cut-away view along lines 3B-3B although showing the entire circumference of the fixed and movable gears. For instance, FIG. 3A is a vertical cut-away along axis A1 of the fully assembled headrest 10, whereas FIG. 3B is a cut-away along lines 3B-3B of the fully assembled headrest, not along the cut away view of FIG. 3A.

In any event, FIG. 3B shows that inner surface of the fixed gear 110 of at least one embodiment has a plurality of teeth or gears disposed thereon, and wherein the outer surface of movable gear 120 includes corresponding and mating teeth or gears thereon. Thus, when the lever 60 is disposed in the normal, biased position, the movable gear 120 is pressed or mated against the fixed gear 110 such that the teeth or gears disposed thereon are engaged with one another, as shown in FIG. 3B, for example.

Figure 3C:
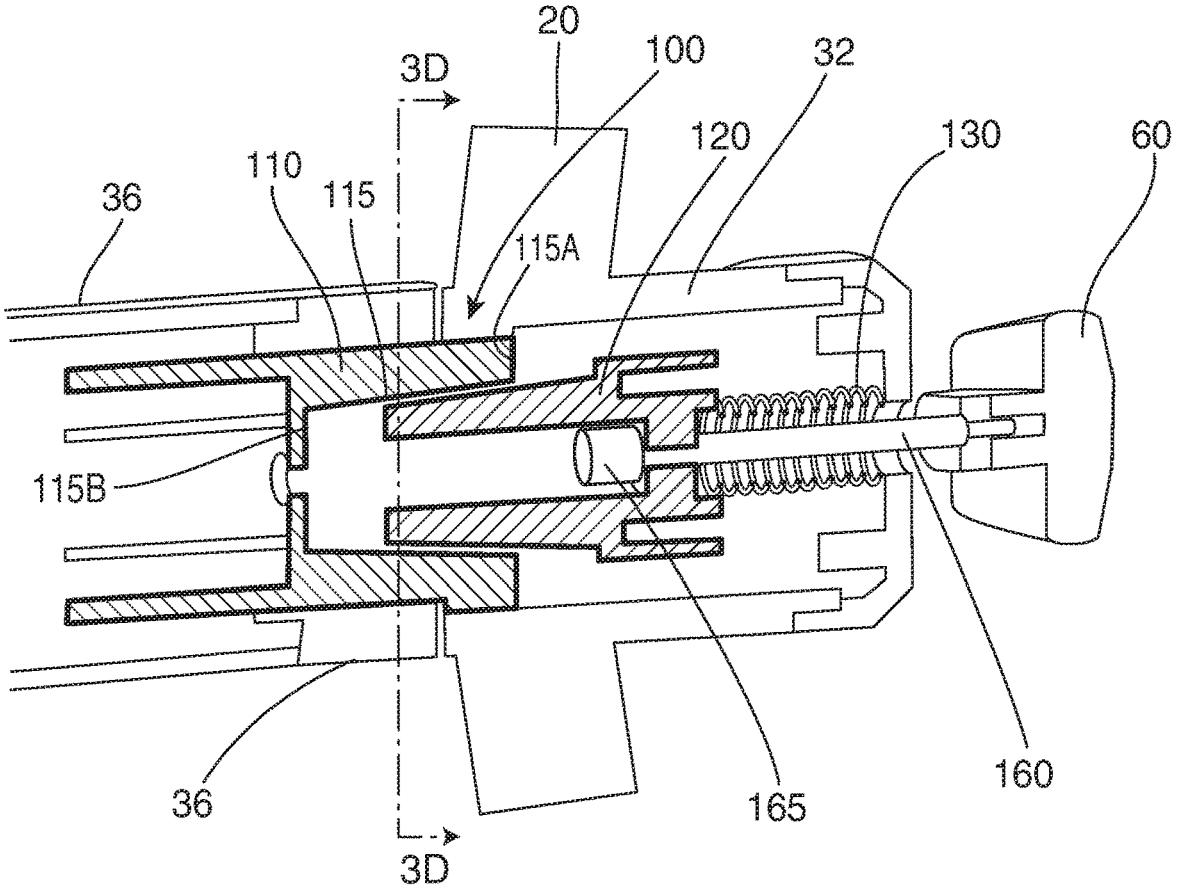
FIG. 3C is a cut-away view of the first lever and the first gear assembly disposed in an unlocked or disengaged condition as disclosed in accordance with at least one embodiment of the present invention.
Figure 3D:
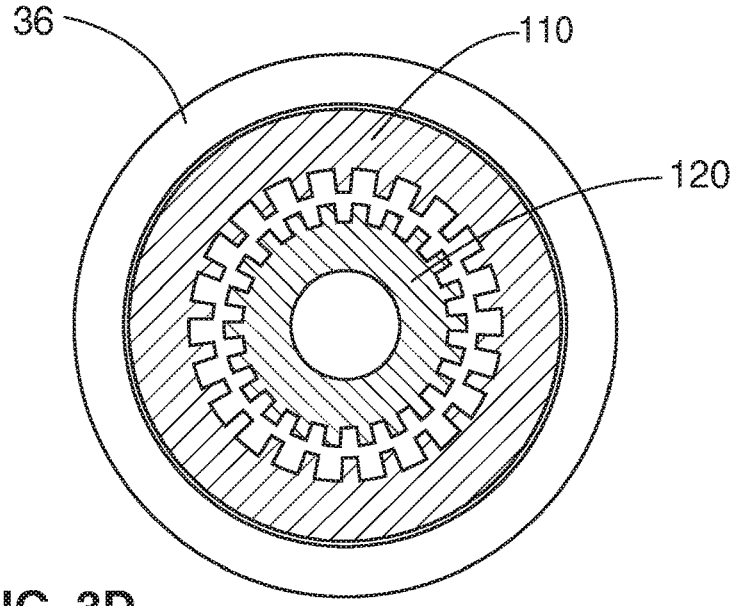
FIG. 3D is another cut-away view of the first gear assembly disposed in an unlocked or disengaged condition as disclosed in accordance with at least one embodiment of the present invention.

When lever 60 is depressed, for example, by pressing inward on proximal end 60A, distal end 60B will move outward against the force of biasing element 130. A pivot point (not shown) of the lever 60 is disposed between the proximal end 60A of the lever 60 and the point at which the rod 160 is attached to the lever 60. As shown in FIG. 3C, this causes the distal end 60B of the lever 60 to move outward from the housing or frame 20, and causes the rod 60 to pull the movable gear 120 away from the fixed gear 110 against the biasing force of spring or biasing member 160. As shown in FIG. 3D, doing so also causes the teeth or gears of the movable gear 120 and fixed gear 110 to separate from one another. This therefore defines the unlocked or disengaged condition of the first gear mechanism or assembly 100. With the first gear mechanism or assembly disposed in the unlocked or disengaged condition, e.g., while the user continuously holds the first lever 60 inward, the headrest 10 can be pivoted or rotated about axis A1, as generally exemplified in FIGS. 2A, 2B and 2C.

More specifically, with the lever 60 depressed in a manner to dispose the first gear assembly 100 into the unlocked or disengaged condition, the user can manually rotate the frame 20 of the headrest 100 about the upper axis A1. Once the user releases the lever 60, the biasing element 130 will force the movable gear 120 back into the engaged relation with the fixed gear, thereby disposing the first gear assembly 100 back into the locked or engaged condition and preventing any further rotation about axis A1.

Referring now to FIGS. 4A, 4B and 4C, the headrest 10 of at least one embodiment is shown being rotatable or movable about second or lower axis A2 via manual manipulation of second lever 62. As mentioned above, in at least one embodiment, depressing the second lever 62 will cause the second gearing mechanism 200 to go into an unlocked condition (thereby allowing rotation of the headrest 10 about second or lower axis A2), while releasing or returning the second lever 62 to its original or normal position causes the second gearing mechanism to go into a locked condition (thereby preventing rotation of the headrest 10 about the second or lower axis A2.)

Figure 5:
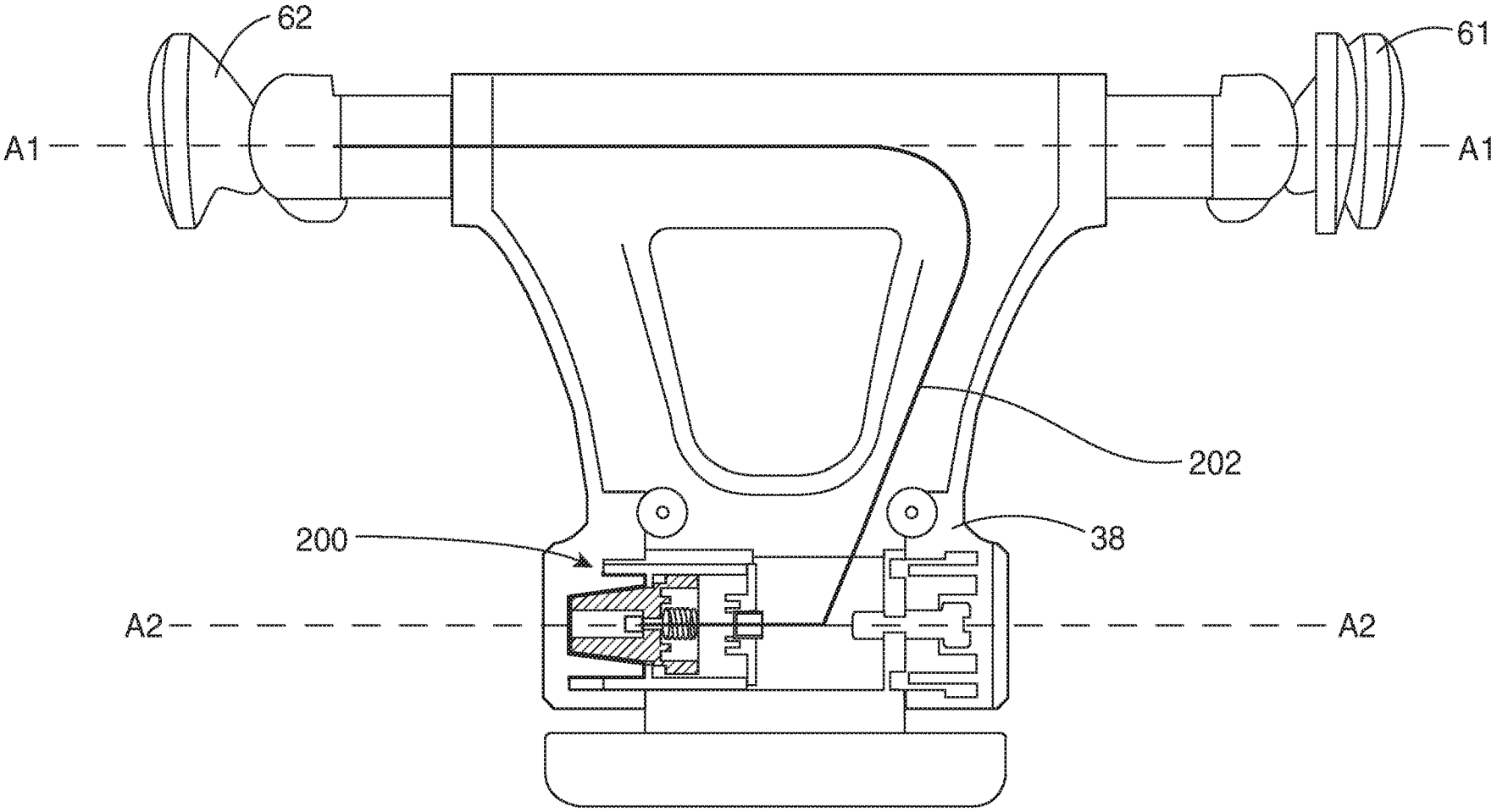
FIG. 5 is a partial internal and cut-away view of a portion of the headrest of at least one embodiment illustrating the second gear assembly as disclosed in accordance with at least one embodiment.

For example, with reference now to FIG. 5, the second gearing mechanism 200 of at least one embodiment is substantially housed in lower housing element 38 and connected to the second lever 62 via cable or elongated element 202. Furthermore, as shown in FIG. 6A, the second gearing mechanism or assembly 200 of at least one embodiment includes a fixed gear 210 and a movable gear 220. Fixed gear 210 of at least one embodiment is secured on the inside of the housing 38 and defines an interior or receiving area 215 within which movable gear 220 is disposed. The cable 202 is attached to the movable gear 220, either directly or indirectly, such that movement of the cable 202 away from the fixed gear 210 causes movement of the movable gear 220 away from the fixed gear 210. In one embodiment, as shown in FIG. 6A, for example, an enlarged attachment knob or head 265 attaches the cable 202 to the movable gear 220. For example, cable 202 may pass through a hole or bore on the end of movable gear 220 wherein knob or enlarged head 265 is secured to or integral with the the cable 202 in a manner to secure the cable 202 to movable gear 220. Other attachment mechanism are contemplated within the full spirit and scope of the present invention.

In at least one embodiment, interior portion 215 of the fixed gear 210 may include a sloped or conical surface that tapers inward from an outer end 215A toward an inner end 215B. Movable gear 220 may include a corresponding sloped or tapered outer surface which mates with inner surface of the fixed gear 210.

Moreover, a spring or other biasing element 230 may be disposed a manner to normally bias the movable gear 220 into a locked engagement with the fixed gear 210, as represented in FIG. 6A. For example, biasing element 230 may normally press against the movable gear 220 on one end and against an interior housing surface 250 at the other end to normally engage the movable gear 220 and the fixed gear 210.

Figure 6B:
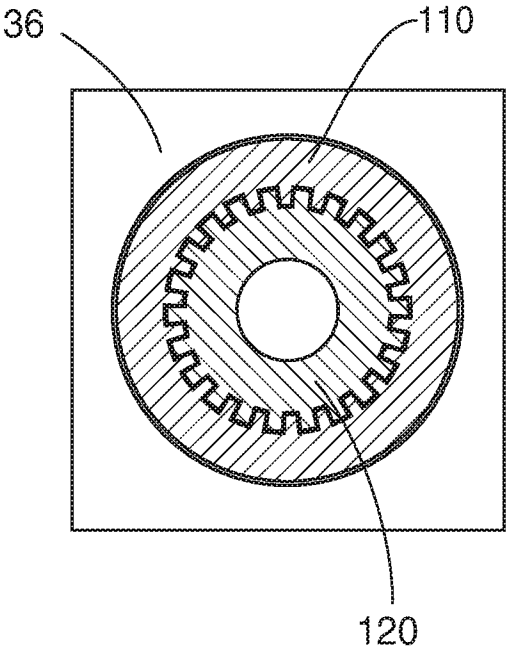
FIG. 6B is another cut-away view of a portion of the second gear assembly disposed in a locked or engaged condition as disclosed herein.
Figure 6A:
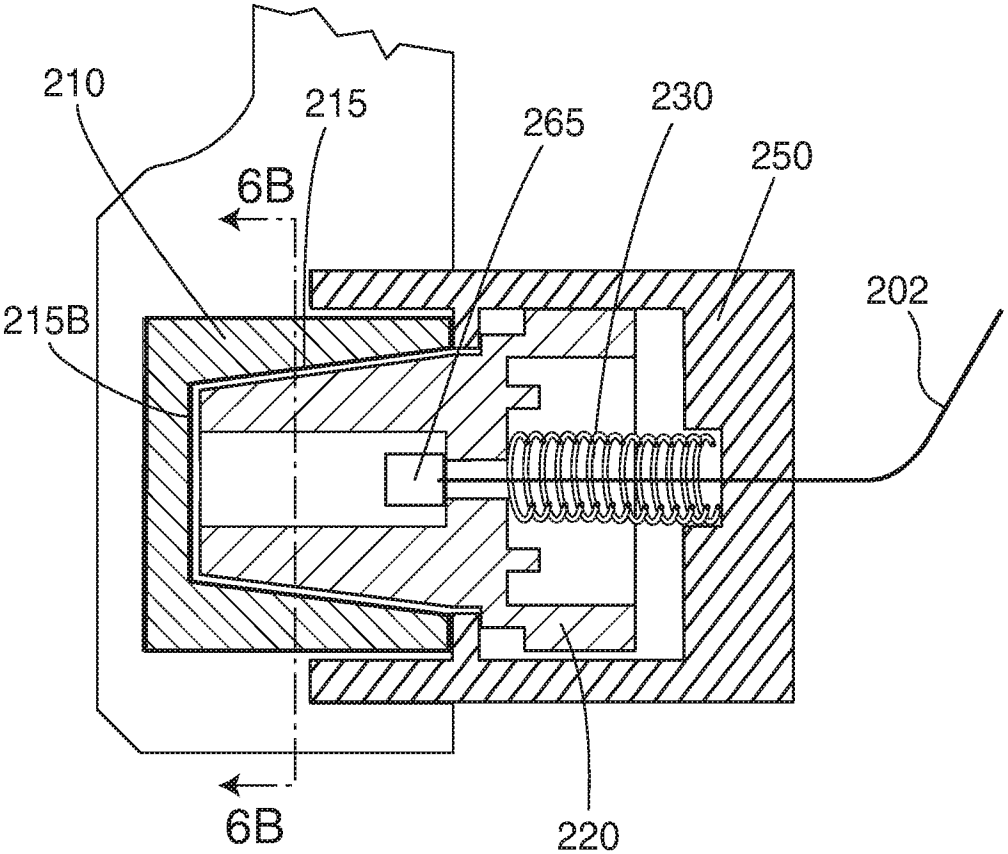
FIG. 6A is a cut-away view of the second gear assembly disposed in a locked or engaged condition as disclosed in accordance with at least one embodiment of the present invention.

FIG. 6B represents a partial cut-away view lines 6B-6B although showing the entire circumference of the fixed and movable gears. For instance, FIG. 6A is a vertical cut-away along axis A2 of the fully assembled headrest 10, whereas FIG. 6B is a cut-away along lines 6B-6B of the fully assembled headrest, not along the cut away view of FIG. 6A.

In any event, FIG. 6B shows that inner surface of the fixed gear 210 of at least one embodiment has a plurality of teeth or gears disposed thereon, and wherein the outer surface of movable gear 220 includes corresponding and mating teeth or gears thereon. Thus, when the lever 60 is disposed in the normal, biased position (e.g., as shown in FIGS. 6A and 6B), the movable gear 220 is pressed or mated against the fixed gear 210 such that the teeth or gears disposed thereon are engaged with one another, as shown in FIG. 6B, for example.

Figure 6D:
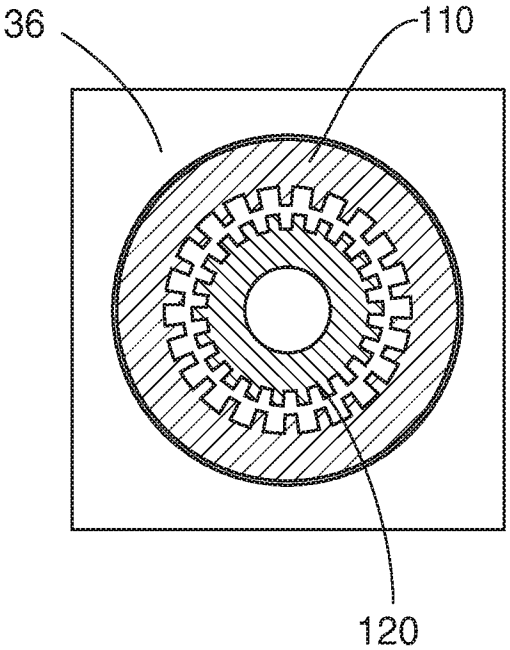
FIG. 6D is another cut-away view of the second gear assembly disposed in an unlocked or disengaged condition as disclosed in accordance with at least one embodiment of the present invention.
Figure 6C:
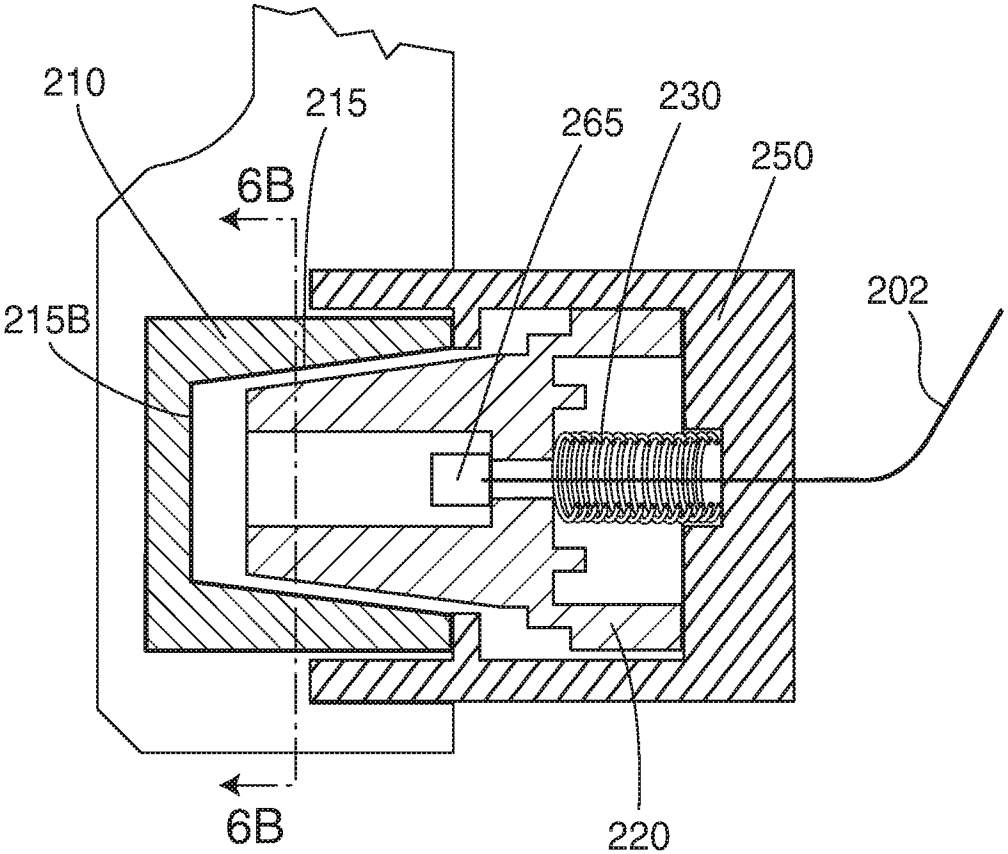
FIG. 6C is a cut-away view of the second gear assembly disposed in an unlocked or disengaged condition as disclosed in accordance with at least one embodiment of the present invention.

When lever 62 is depressed, for example, by pressing inward on proximal end 62A, the cable 202 will be pulled outward along with the distal end 62B of the lever against the force of biasing element 230. A pivot point (not shown) of the lever 62 is disposed between the proximal end 62A of the lever 62 and the point at which the cable 202 is attached to the lever 62. As shown in FIG. 6C, this causes the distal end 62B of the lever 62 to move outward from the housing or frame 20, and causes the cable 202 to pull the movable gear 220 away from the fixed gear 210. As shown in FIG. 6D, doing so also causes the teeth or gears of the movable gear 220 and fixed gear 210 to separate from one another. This therefore defines the unlocked or disengaged condition of the second gear mechanism or assembly 200. With the first gear mechanism or assembly disposed in the unlocked or disengaged condition, the headrest 10 can pivot or rotate about axis A2, as generally exemplified in FIGS. 4A, 4B and 4C.

More specifically, with the lever 62 depressed in a manner to dispose the second gear assembly 200 into the unlocked or disengaged condition, the user can manually rotate the frame 20 of the headrest 10 about the second or lower axis A2. Once the user releases the lever 62, the biasing element 230 will force the movable gear 220 back into the engaged relation with the fixed gear 210, thereby disposing the second gear assembly 200 back into the locked or engaged condition and preventing any further rotation about axis A2.

Figure 7:
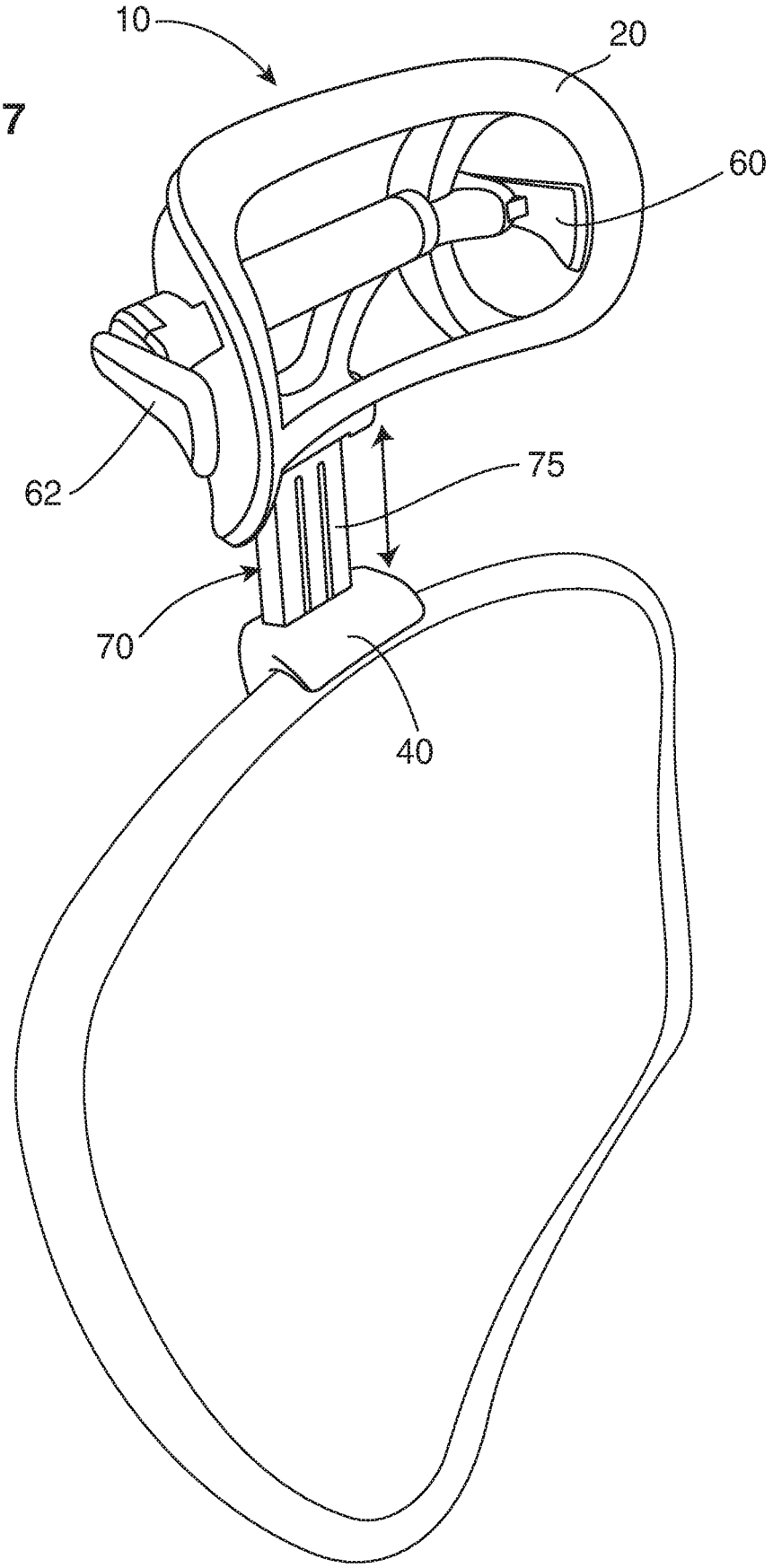
FIG. 7 is a front left perspective view of the headrest and a portion of the chair with the neck mechanism extended as disclosed in accordance with at least one embodiment of the present invention.
Figure 8A:
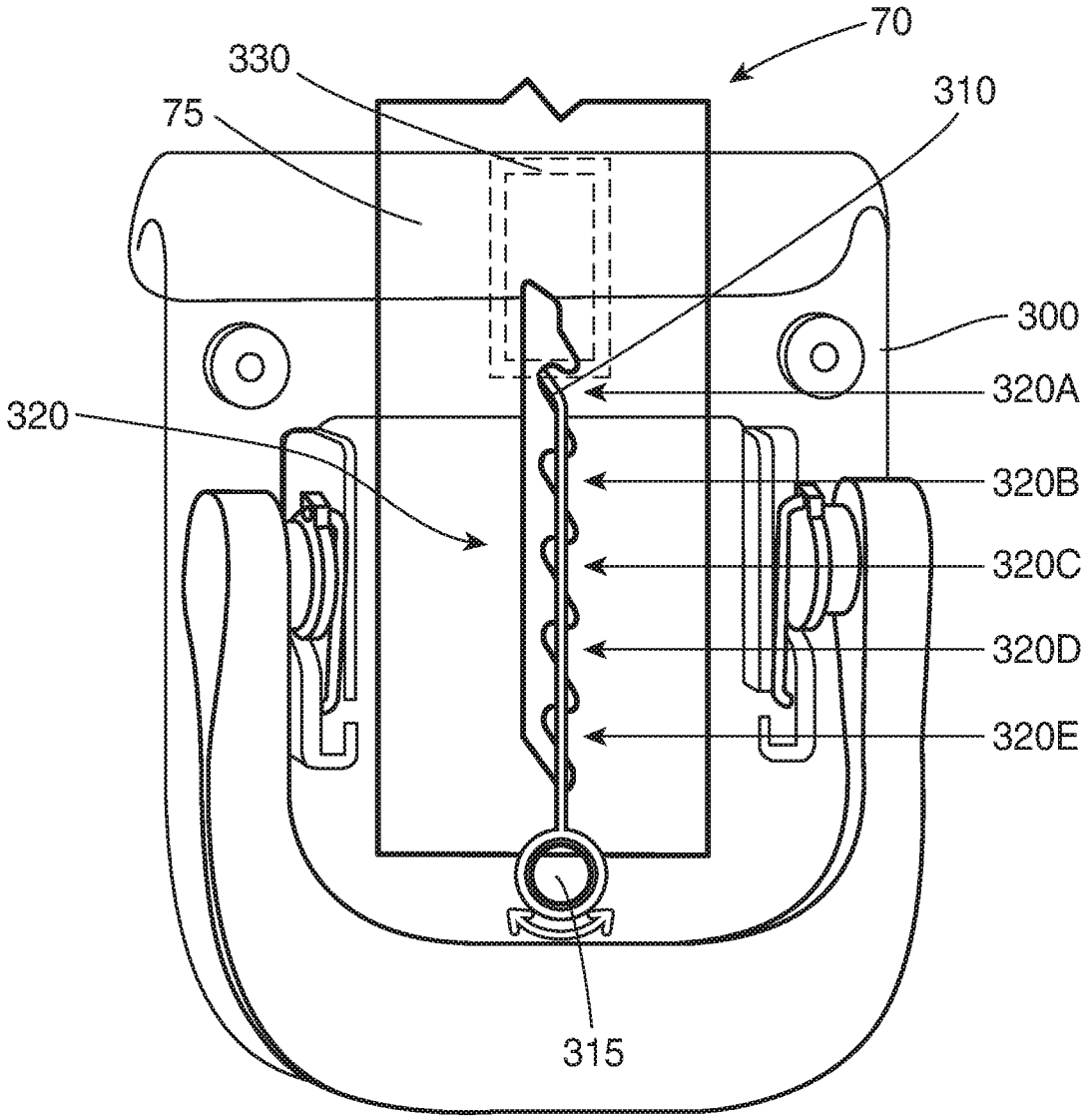
FIG. 8A is a partial internal view of the neck mechanism disposed in a lowermost position as disclosed in accordance with at least one embodiment of the present invention.
Figure 8B:
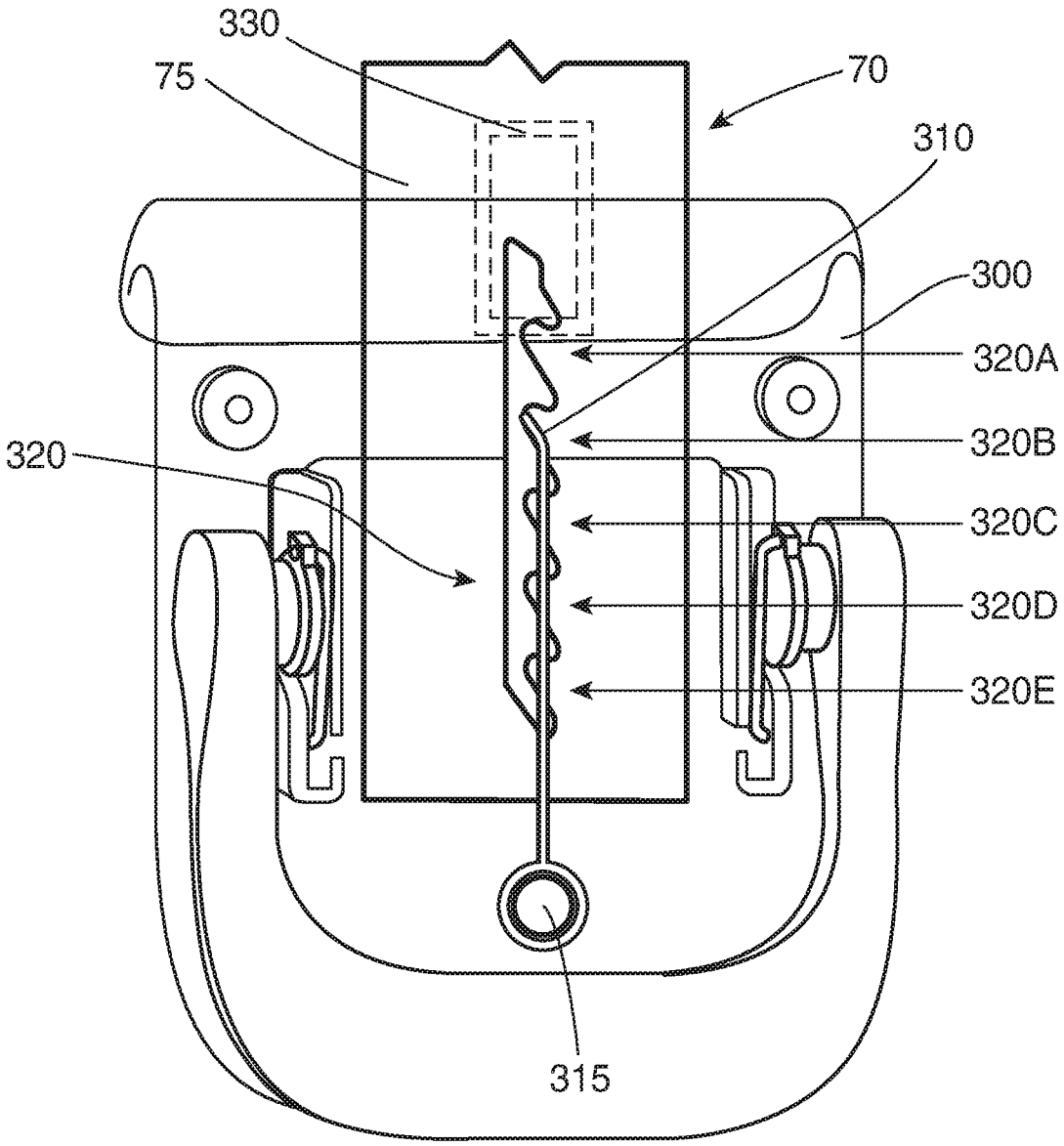
FIG. 8B is a partial internal view of the neck mechanism disposed in a next successive position as disclosed in accordance with at least one embodiment of the present invention.
Figure 8C:
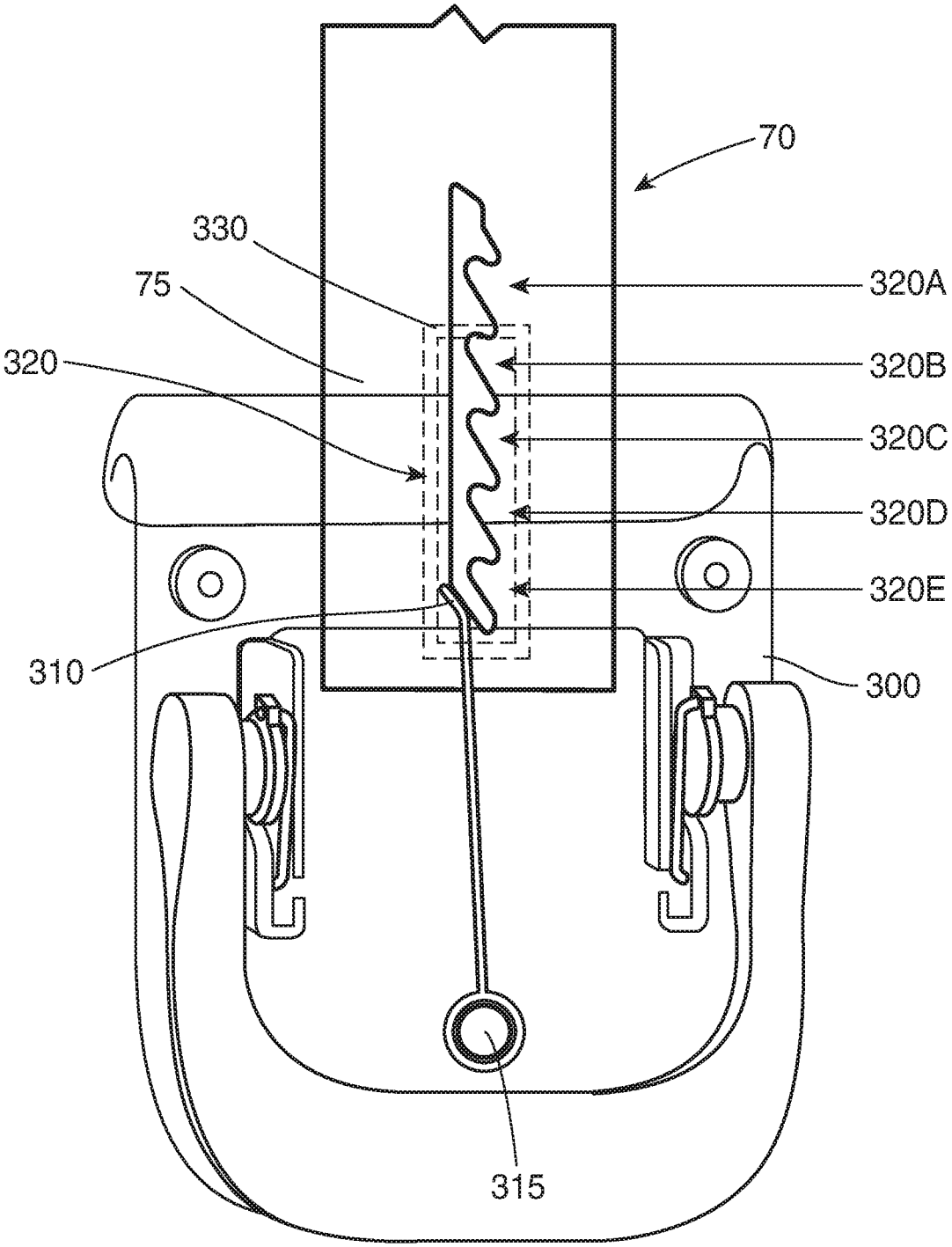
FIG. 8C is a partial internal view of the neck mechanism being disposed from the uppermost position back to the lowermost position as disclosed herein.

Referring now to FIGS. 7 through 8C, an exemplary neck mechanism 70 is shown. In particular, the neck mechanism 70 of at least one embodiment is structured and configured to raise and lower the headrest 10, for example, along a vertical or y-axis, in order to adjust the height of the headrest 10. FIG. 7 illustrates the headrest 10 in a raised position with at least a portion 75 of the neck mechanism 70 exposed.

Internal to the neck mechanism 70 may be hardware or other components and mechanical elements that enable the neck mechanism 70 and headrest frame 20 to raise and lower in a vertical, at least partially vertical or substantially vertical orientation or direction. For example, in at least one embodiment, the neck mechanism 70 may include a pin 310 that engages a zig-zag element 320 formed in the neck housing 300 to enable a user to raise and lower the movable neck portion 75 to a series of different levels, after which the neck mechanism 70 resets and returns the headrest to a base portion or base position.

For instance, FIG. 8A shows the neck mechanism 70 in a base position at the lowest level of articulation. In this manner, the pin element 310 is disposed within the uppermost or top zig-zag opening or recess 320A of the zig-zag element 320. The user may manually pull or raise the movable neck portion 75 for example by pulling the neck portion 75 up and away from housing 300. Doing so will cause the pin element 310 to pivot or slide out of the zig-zag opening or recess 320A and engage the next succeeding zig-zag opening, e.g., 320B, as shown in FIG. 8B. In this manner, the user can successively pull or extend the neck portion 75 out of the housing 300 as the pin element 310 continues to engage the next succeeding recess in order starting at the uppermost recess 320A (defining the lowest neck height) and successively moving to levels 320B, 320C, 320D and 320E. In this example, there are five predefined levels or heights defined by five successive recesses in height-adjustment element 320. Other embodiments may include more or less levels. In addition, while element 320 is illustrated as include a zig-zag patter in the exemplary embodiment, the element 320 of other embodiments may have a different shape in order to accomplish or implement a similar adjustment mechanism.

When the neck mechanism 70, and in particular, the neck portion 75 thereof, reaches the maximum height, e.g., when the pin element 310 is in the lowermost recess, e.g., recess 320E in the example shown, as the user attempts to extend the neck element 75 past the final recess 320E, the pin element 310 reorients into a channel 330 that resents the neck mechanism 70 to the base level. In other words, raising the neck portion 75 past the maximum height will cause the pin element 310 to follow channel 330 along the opposite side of the adjustment element 320 (opposite the recesses 320A-E) where the pin element 310 will again re-engage the uppermost recess 320A of the adjustment mechanism 320.

Still referring to FIGS. 8A through 8C, the pin element 310 may be at least partially pivotally disposed within housing 300, for example, via a pin mount 315. This allows the pin to move into and out of the different positions described above, for example, into and out of the recesses 320-E, and about the backside of the adjustment element 320 in order to reorient the neck portion 75 to the lowest height.

Furthermore, it should be noted that in this embodiment, the neck portion 75 cannot be pushed down into the housing to lower the neck mechanism 70. Rather, in order to lower the neck mechanism 70 of at least one embodiment, the user may raise the neck portion 75 until the pin element resets, as described above. In this manner, the neck portion 75 of at least one embodiment may only be manually pulled up and/or out of the housing 300 to raise the neck portion 75 and ultimately reset or lower the neck portion 75, as desired.

Other neck mechanisms configured to raise and/or lower the neck of the headrest 10 are contemplated within the full spirit and scope of the present invention.

Figure 9A:
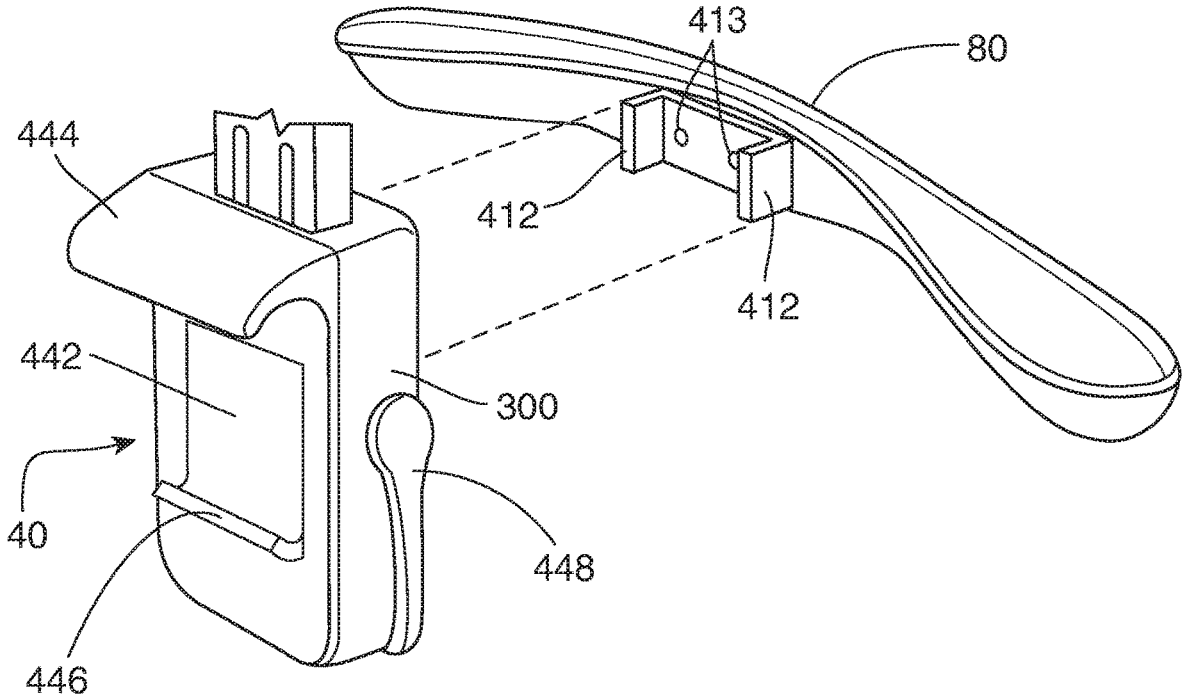
FIG. 9A is a perspective view of the clamping mechanism and optional support bar as disclosed in accordance with at least one embodiment of the present invention.
Figure 9B:
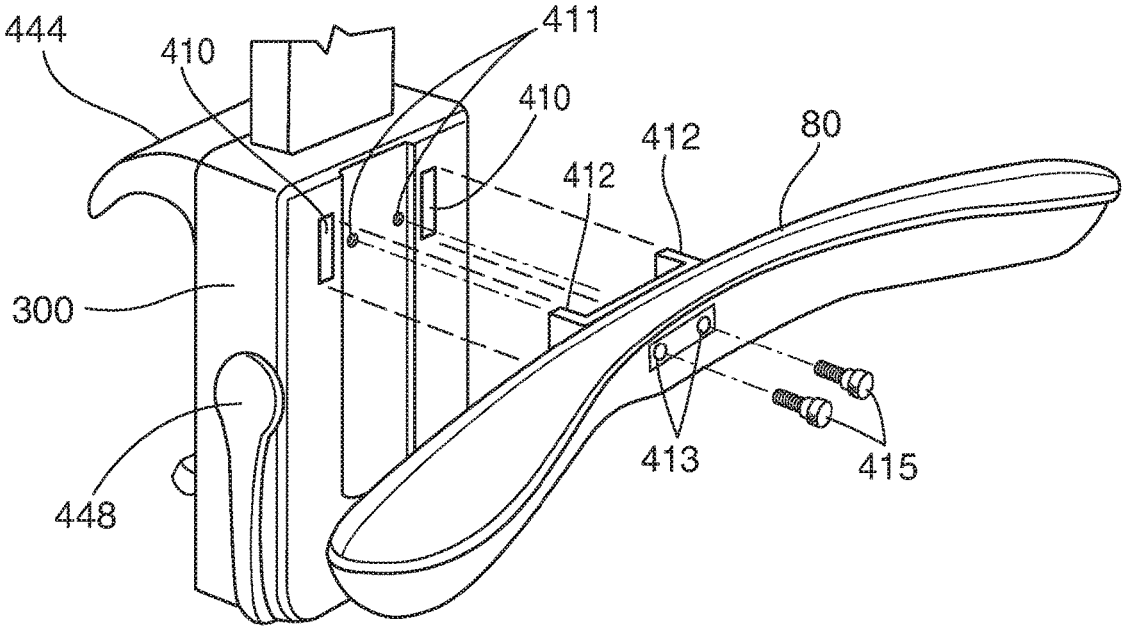
FIG. 9B is another perspective view of the clamping mechanism and optional support bar as disclosed in accordance with at least one embodiment of the present invention.
Figure 9C:
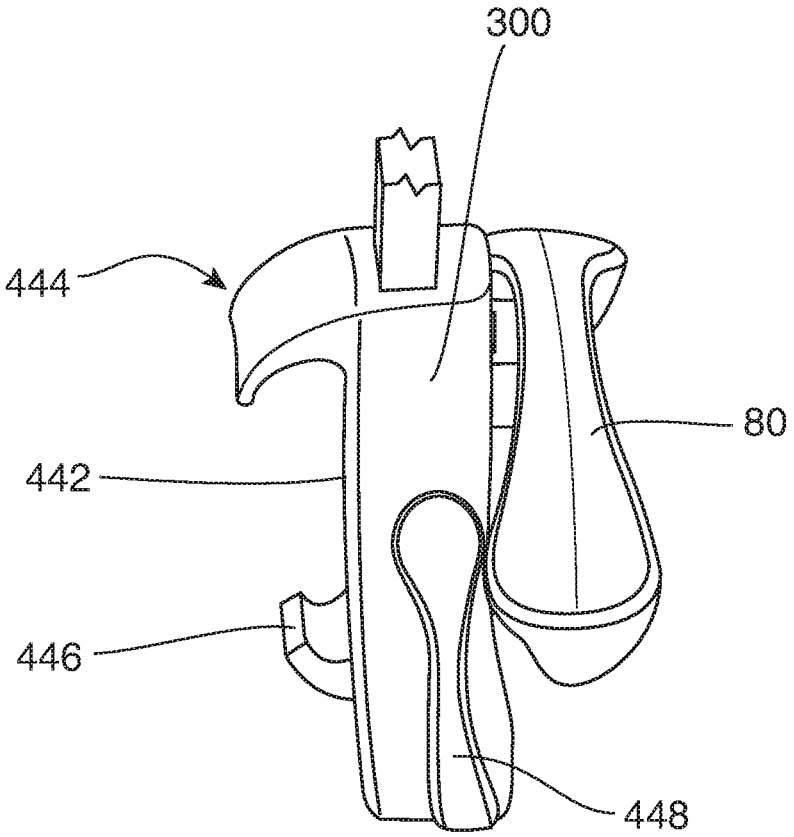
FIG. 9C is a side view of the clamping mechanism and optional support bar as disclosed in accordance with at least one embodiment of the present invention.

Referring to FIGS. 9A, 9B and 9C, an exemplary clamping mechanism 40 is shown. In some embodiments, the clamping mechanism 40 may be used to removably secure the headrest 10 to a desk chair or other furniture for use as described herein. For instance, the clamping mechanism 40 of at least one embodiment may include a planar surface 442 that faces the rear of the chair when in use. An upper arcuate hook portion 444 and lower arcuate hook portion 446 may be formed on or near the planar surface and be configured to engage with the desk chair. In some embodiments, each of the upper arcuate hook portion 444 and lower arcuate hook portion 446 include a curved, semi-cylindrical channel that runs along with the width or a portion of the width of the clamping mechanism 40. A handle 448 may be rotatably or pivotally connected at the outer edges of clamping mechanism 40 to various clamping hardware stored inside the clamping mechanism 40. In some cases, the handle 448 may be U-shaped and ergonomically configured to receive the hand of a user and to provide leverage sufficient to manually close the clamp around the chair or other furniture.

In particular, FIG. 9C shows a side view of an exemplary clamping mechanism 40 as disclosed in accordance with at least one embodiment of the present invention. For instance, in at least one embodiment, one of the arcuate hook portions (e.g., one of the upper hook portions 444 and lower hook portions 446) is fixed, and the other one is movable. In the embodiment shown, the upper hook portion 44 is fixed and the lower hook portion 446 is movable via manipulation of handle 448. For example, to close the clamping mechanism 40, a user may engage the fixed arcuate hook portion with a first chair surface (e.g., the upper edge of the chair back). The user may then turn, pivot or rotate the handle portion 448 into a closed position causing the clamping hardware to pull the movable arcuate hook portion toward the fixed portion, causing the clamp to close or clamp shut.

For instance, handle 448 may swing upward and downward as shown via arrow 449 in FIG. 9A. Pivoting or swinging the handle 448 upward and outward will open the clamping mechanism, e.g., by moving lower hook 446 away from upper hook 444. Similarly, pivoting or swinging the handle 448 downward and inward will cause the hooks 444, 446 to remain in place, thereby engaging the chair.

The configuration of the handle 448, upper arcuate hook portion 244 and lower arcuate hook portions, and internal hardware provide a firm connection between the headrest 10 and the chair 1 without tools of any kind, simplifying the installation and removal of the device. Further, the lack of a screw-in assembly obviates the risk that the device will loosen over time or abruptly fall off the chair, potentially damaging the device or injuring the user.

It should be noted that in some embodiments, both or one of the arcuate hook portions 444, 446 may be lined or coated with a material that enhances the frictional contact between the headrest 10 and the chair 1 or other furniture to produce a more secure fit therebetween.

Removal of the clamping mechanism 40 from the chair 1 involves releasing the handle portion 448, for example, by raising or pivoting/rotating the handle upwards, which will move the movable arcuate hook portion away from the fixed arcuate hook portion, allowing the clamping mechanism 40, and therefore the headrest 10, to be removed from the chair 1 or other furniture, again without any tools.

In some embodiments, and still referring to FIGS. 9A, 9B and 9C, a lateral or auxiliary support element 80, such as a support hanger, may be installed, for example, on the rear of the device 10 to provide support for the user's personal items, such as a jacket, shirt, scarf, hat, purse, bag, etc. In this manner, the lateral or auxiliary support element 80 may function much like a coat or clothes hanger in that it can support various personal or clothing items hung therefrom.

In some embodiments, the removable attachment of the support element 80 may be accomplished by a spring-loaded push button engagement with corresponding holes or slots 410 on the rear of the device 10. For example, the rear of the device or headrest 10 may include one or more slots or holes 410, such as on or extending at least partially within, the rear of the housing 300, as shown in FIG. 9B. In this manner, the support element 80 may include one or more corresponding knobs, extensions or attachment pieces 412 which correspondingly fit at least partially within the slots or holes 410 disposed on or extending at least partially within the housing 300. One or more spring loaded pieces, grooves, knobs, channels, clips, etc. may be incorporated within the housing 300 and/or on the knob(s) 412 in order to enhance or further facilitate the attachment between the support element 80 and the device or headrest 10.

In some cases, the knobs or extensions 412 may frictionally fit within the corresponding holes 410 such that a user can easily insert attach and remove the hanger or auxiliary support element 80 to and from the headrest 10.

In further embodiments, one or more fasteners 415 may be used to secure the support element 80 to the housing 300 or headrest 10. In this manner, one or more corresponding holes 413 may extend at least partially, or in some cases completely, through the support element 80 and align with mounting holes 411 disposed on or at least partially within housing 300. Fastener(s) 415 may thus extend through the support element 80 and at least partially into the housing 300 via holes 413, 411. In some embodiments, fastener(s) 415 and holes 411 may include corresponding threaded components such that fastener(s) 415 may screw into hole(s) 411 in order to removably fix or secure the support element 80 to the housing 300 or headrest 10.

Accordingly, as shown in the exemplary embodiment of FIG. 9B, fasteners 415 may be in the form of or otherwise include hand screws which can be easily tightened and/or released (e.g., screwed and unscrewed) with a user's hands. This allows the support element 80 to be attached and removed from the housing 300 or headrest 10 without the use of a tool, such as a screw driver, hex key, Allen wrench, etc. Other embodiments may use butterfly screw, wing bolt, or other like fastener.

Although FIGS. 9A, 9B and 9C illustrate the support element 80 as including extensions 412 and fasteners 415 (and corresponding holes 413), it should be noted that other embodiments may use or incorporate only the extensions 412 (and not the fastener(s) 415), whereas yet other embodiments may use or incorporate only the fasteners 415 and holes 413 (and not the extensions 412).

In yet another embodiment, it is contemplated that the support element 80 is affixed to the headrest 10 or housing 300 in a manner such that it is not intended to be removable therefrom or otherwise not manually removably without out the use of tools. Accordingly, in some cases, the support element 80 may be integral with or affixed to the housing 300 or headrest 10 with adhesives, screws, bolts, etc.

In any event, when the auxiliary support element 80 is attached to the headrest 10 or housing 300, as shown in FIG. 9C, for example, the auxiliary support element 80 defines or otherwise includes an elongated element that, in many cases, extends beyond the sides of the headrest 10 and which can support personal items being hung or draped thereon much like a clothes hanger. As shown, the support element 80 may include a generally horizontal hanger which may include a slight downward curve or contour extending from the center and curving slightly downward toward the two opposite extremity ends. Other shapes and configurations are contemplated within the spirit and scope of the various embodiments.

Thus, the foregoing discloses and describes exemplary embodiments of the present disclosure for clarity. As will be understood by those skilled in the art, the present invention may be embodied in other specific forms without departing from the spirit or essential characteristics thereof and aspects of the exemplary embodiments described herein may be combined differently to form additional embodiments or omitted. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

Unless stated otherwise, all scientific and technical terms used herein have the meaning commonly used ordinary skill in the art to which this invention pertains. In the event of any kind whatsoever, controversy has priority the present application and definitions contained therein. In addition, the use of the terms in the singular include the plural, and the use of the plural includes the singular except where the context requires otherwise. All mentioned herein publications, patents, and other materials are incorporated herein in their entirety and for all possible purposes by reference.

As used herein, the terms "comprise," "comprising," "include," "including," "having," "having," and any other of their shape, are meant to include the object, but does not mean exclusion of any other object or a group of objects. For example, a method, article, or apparatus comprising a set of elements is not necessarily limited to those elements and may include other elements not specified explicitly or typical for such composition, mixture, process, method, article or device. Moreover, unless explicitly stated otherwise, the term "or" includes but not exclusive "or."

As used herein, the terms "consisting of" and "consisting of" and their other forms used in the specification and claims, indicate the inclusion of an object or group of objects and the inability to add to the described method, the structure, the structure or composition of any whatsoever another object or group of objects.

As used herein, the term "consist essentially of" and "consisting essentially of" and their other forms used in the specification and claims, indicate the inclusion of any objects or groups of objects and the inclusion of any other objects or groups of objects that are not lead to a substantial change in the basic or novel properties of the described method, structure, design or composition.

Also, the indefinite articles preceding the name of an element of the present invention is not intended to limit the size, i.e., amount in which the element is present, or uses. Accordingly, the indefinite article should be interpreted as an indication of the presence of one or at least one object, using the name of the corresponding element in the singular also includes the plural except where the context obviously implies the singular.

The term "invention," "present invention," or "the present invention" as used herein is not limiting and encompasses all embodiments described herein, but does not refer to any single embodiment of the invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A removable and adjustable headrest capable of being manually installed without the assistance of a tool, said removable and adjustable headrest comprising:

a headrest frame, an adjustable clamping mechanism, an adjustable neck mechanism, a rocking arm assembly connected between said headrest frame and said adjustable neck mechanism, at least one activation lever connected to said headrest frame, said at least one activation lever being manually disposable between a normal position and an activated position, and at least one gear assembly connected to said at least one activation lever, said at least one gear assembly being disposable between a normal locked condition and an unlocked condition, said gear assembly being disposed in said normal locked condition when said at least one activation lever is disposed in said normal position, said at least one gear assembly being disposed in said unlocked condition when said at least one activation lever is disposed in said activated position.

2. The headrest as recited in claim 1 wherein said at least one gear assembly provides adjustment of said headrest about at least one axis.

3. The headrest as recited in claim 2 wherein said at least one activation lever comprises a first activation lever and a second activation lever, and wherein said at least one gear assembly comprises a first gear assembly and a second gear assembly.

4. The headrest as recited in claim 3 wherein said first activation lever is configured to activate said first gear assembly and said second activation lever is configured to activate said second gear assembly.

5. The headrest as recited in claim 4 wherein said first gear assembly allows adjustment of said headrest about a first axis and said second gear assembly allows adjustment of said headrest about a second axis.

6. The headrest as recited in claim 5 wherein said first axis and said second axis a at least substantially parallel horizontal axes spaced from one another.

7. The headrest as recited in claim 5 wherein said first axis is an upper axis and said second axis is a lower axis.

8. The headrest as recited in claim 5 wherein said first activation lever and said second activation lever are attached to said headrest frame.

9. The headrest as recited in claim 8 wherein said first activation lever extends outward from a first side of the headrest frame and toward a front face of said headrest, and wherein said second activation lever extends outward from a second side of the headrest frame toward said front face of said headrest, said first side of said headrest being opposite said second side of said headrest.

10. The headrest as recited in claim 9 wherein said first activation lever and said second activation lever are accessible to a user properly seated in a chair to which the headrest is attached.

11. The headrest as recited in claim 9 wherein said first axis is defined as an upper axis and said second axis is defined as a lower axis, wherein said first activation lever and said second activation lever are at least partially disposed along said upper axis.

12. The headrest as recited in claim 11 wherein said first gear assembly is at least substantially disposed within a first housing element disposed along said upper axis.

13. The headrest as recited in claim 12 wherein said second gear assembly is at least substantially disposed within a second housing element disposed along said lower axis.

14. The headrest as recited in claim 13 wherein said first gear assembly is disposed into said unlocked position via manual manipulation of said first lever disposing a first movable gear element out of engagement with a first fixed gear element.

15. The headrest as recited in claim 14 wherein said second gear assembly is disposed into said unlocked position via manual manipulation of said second lever disposing a second movable gear element out of engagement with a second fixed gear element.

16. The headrest as recited in claim 15 wherein said second activation lever is connected to said second gear assembly via a cable connected to and extending from said second activation lever.

17. The headrest as recited in claim 1 further comprising an auxiliary support element attached to a rear portion of said headrest and extending laterally to define a hanger upon which a personal item can hang.

18. The headrest as recited in claim 17 wherein said auxiliary support element is removably attached to said headrest.

19. The headrest as recited in claim 18 wherein said auxiliary support element comprises at least one attachment knob and said headrest comprises at least one corresponding hole disposed on said rear portion, said at least one attachment knob being removably engaged within said at least one corresponding hole when said auxiliary support element is attached to said headrest.

20. A removable and adjustable headrest assembly, said removable and adjustable headrest assembly comprising:

a headrest frame, an adjustable clamping mechanism, a housing, a rocking arm assembly connected between said headrest frame and said housing, a first activation lever manually disposable between a normal position and an activated position, a second activation lever manually disposable between a normal position and an activated position, a first gear assembly connected to said first activation lever, said first gear assembly being disposable between a normal locked condition and an unlocked condition, said first gear assembly being disposed in said normal locked condition when said first activation lever is disposed in said normal position, said first gear assembly being disposed in said unlocked condition when said first activation lever is manually depressed into said activated position, a second gear assembly connected to said second activation lever, said second gear assembly being disposable between a normal locked condition and an unlocked condition, said second gear assembly being disposed in said normal locked condition when said second activation lever is disposed in said normal position, said second gear assembly being disposed in said unlocked condition when said second activation lever is manually depressed into said activated position, and an auxiliary support element removably attached to a rear portion of said housing, said auxiliary support elements extending in a substantially lateral direction relative to said housing to define a hanger upon which at least one personal item can hang.

* * * * *